US012759753B2

(12) United States Patent
Linssen

(10) Patent No.: US 12,759,753 B2
(45) Date of Patent: Oct. 13, 2026

(54) PACKAGE

(71) Applicant: Ecobliss Packaging Group B.V., Echt (NL)

(72) Inventor: Ronaldus Josephus Marie Linssen, Linne (NL)

(73) Assignee: Ecobliss Packaging Group B.V., Echt (NL)

( * ) Notice: Subject to any disclaimer, the term of this patent is extended or adjusted under 35 U.S.C. 154(b) by 20 days.

(21) Appl. No.: 18/748,797

(22) Filed: Jun. 20, 2024

(65) Prior Publication Data

US 2025/0026530 A1 Jan. 23, 2025

(30) Foreign Application Priority Data

Jul. 21, 2023 (NL) ..... 2035450

(51) Int. Cl.
*B65D 5/72* (2006.01)
*B65D 5/02* (2006.01)

(52) U.S. Cl.
CPC ..... *B65D 5/728* (2013.01); *B65D 5/02* (2013.01); *B65D 2215/02* (2013.01)

(58) Field of Classification Search
CPC ..... B65D 5/728; B65D 5/02; B65D 2215/02; B65D 2583/0454; B65D 83/0463;
(Continued)

(56) References Cited

U.S. PATENT DOCUMENTS 1,130,271 A * 3/1915 Hammond ..... B65D 5/685 206/815
6,047,829 A 4/2000 Johnstone
(Continued)

FOREIGN PATENT DOCUMENTS

EP 4169844 A1 4/2023
GB 2488451 A 8/2012
(Continued)

OTHER PUBLICATIONS

UK Patent Application Search Report for GB2408767.8 dated Sep. 19, 2024, 4 pages.
(Continued)

*Primary Examiner* — Christopher R Demeree
(74) *Attorney, Agent, or Firm* — Barnes & Thornburg LLP

(57) ABSTRACT

A package comprising a housing and a slide being slidably in a sliding direction accommodated in the housing from a locked position wherein the slide is locked inside the housing and at least an intermediate position wherein the slide is partly located outside a front opening of the housing. The housing comprises at least a bottom wall, a top wall and longitudinal side walls extending in the sliding direction, whereby the bottom wall and the top wall are connected to each other by means of the side walls. The slide is provided with at least one extension lockable under spring force in the locked position in a blind recess located in the top wall of the housing near a rear end of the housing. The at least one extension is movable against spring force out of the recess to allow the slide to be movable to at least the intermediate position. The slide is provided with at least one other extension lockable under spring force in the locked position in a blind recess located in the bottom wall of the housing, whereby the at least one extension as well as the at least one other extension must be moved both out of the corresponding recess to allow the slide to be movable to at least the intermediate position and/or the bottom wall, the top wall and/or the side wall of the housing is provided with at least one passage, through which a rear side of the slide is reachable for pushing the slide from the locked position towards the intermediate position.

12 Claims, 38 Drawing Sheets

(58) Field of Classification Search
CPC .. B65D 5/38; B65D 2215/06; B65D 2215/04; B65D 77/0433; B65D 2215/00; B65D 11/12; B65D 2251/1066; B65D 43/12
USPC ..... 229/122, 125.125, 102, 125.26, 125.28, 229/160.2; 206/531, 1.5, 528, 807, 815, 206/267; 220/345.3
See application file for complete search history.

(56) References Cited

U.S. PATENT DOCUMENTS

| | | | | |
|---|---|---|---|---|
| 11,254,464 | B2 * | 2/2022 | Chen | B65D 5/4266 |
| 12,397,962 | B2 * | 8/2025 | Bressan | B65D 5/685 |
| 2009/0184023 | A1 | 7/2009 | Brollier | |
| 2013/0140201 | A1 * | 6/2013 | Ghini | B65D 85/1036 206/267 |
| 2016/0251107 | A1 | 9/2016 | Everett | |
| 2019/0062023 | A1 | 2/2019 | Lantz | |
| 2020/0189813 | A1 | 6/2020 | Drosos | |

FOREIGN PATENT DOCUMENTS

| | | | |
|---|---|---|---|
| WO | 2002038454 | A1 | 5/2002 |
| WO | 2011099034 | A2 | 8/2011 |

OTHER PUBLICATIONS

Netherlands Search Report for priority application Netherlands Patent App. No. NL2035450, dated Jan. 10, 2024, 13 pages, No English Translation Available.
Netherlands Search Report for priority Netherlands Patent App. No. DL2035450 dated Feb. 2, 2024, 13 pages.
Restriction Requirement for U.S. Appl. No. 18/954,609 mailed Aug. 6, 2026, 5 paves.

* cited by examiner

PACKAGE

PRIORITY CLAIM

This application claims priority to Netherlands Patent Application No. NL2035450, filed Jul. 21, 2023, which is expressly incorporated by reference herein.

BACKGROUND

The present disclosure relates to a package, and particularly to a package that is child resistant.

SUMMARY

At least one of the objects of the present disclosure is to provide a package which is child resistant and senior-friendly, meaning that young children can not open it, whilst seniors will be able to open it easily.

This object is accomplished with the package according to the present disclosure in that that the slide is provided with at least one other extension lockable under spring force in the locked position in a blind recess located in the bottom wall of the housing, whereby the at least one extension as well as the at least one other extension must be moved both out of the corresponding recess to allow the slide to be movable to at least the intermediate position and/or the bottom wall, the top wall and/or the side wall of the housing is provided with at least one passage, through which a rear side of the slide is reachable for pushing the slide from the locked position towards the intermediate position.

By having at least one additional operation to be performed to move the slide towards the front opening, a child will not be able to open the packaging or will have difficulties to open it.

Such an additional operation is used when having two extensions cooperating with recesses in the top wall and in the bottom wall respectively, whereby a person must move both extensions out of the corresponding recesses before the slide can be moved to the intermediate position. In the intermediate position access to the content of the slide is preferably possible.

If a person first moves one extension out of its corresponding recess, subsequently release the one extension to move the other extension out of its corresponding recess, the one extension will move back under spring force into engagement with its corresponding recess. So both extensions must be moved out of the corresponding recesses and remain in such unlocked position before the slide is movable to at least the intermediate position. Preferably the extensions are moved simultaneously out of the corresponding recesses.

For a young child it will be hard or even impossible to move both extensions out of engagement of the recesses and to move the slide out of the housing. For a senior such operation will be easily to perform.

The extensions might be accessible to be moved against spring force through openings in the housing or might be accessible to be moved against spring force by pressing on a part of the housing.

Such an additional operation is also necessary when the bottom wall, the top wall and/or the side wall of the housing is provided with at least one passage, through which a rear side of the slide is reachable for pushing the slide from the locked position towards the intermediate position. In such a case the slide can not be moved unless firstly a person moves the extension out of its corresponding recess and secondly the person puts for example his finger into the passage to push the slide towards the intermediate position into un unlocked position. As soon as the slide has been pushed into un unlocked position, whereby it is located slightly out of the front opening, a person may grip a front end of the slide and pulls the slide further out of the housing.

It will be even more difficult for a young child if it needs to perform both additional operations so move both extensions out of engagement of the recesses, subsequently puts his finger into the passage to push the slide towards the intermediate position into un unlocked position, grip a front end of the slide and pull the slide further out of the housing. For a young child it will be hard to move both extensions out of engagement of the recesses and find the mechanism of pushing the slide to the unlocked position and subsequently move the slide out of the housing. For a senior such operation will be easily to perform.

The front opening of the housing can be completely closed by the slide, so that access to the interior of the package via the front opening is efficiently prevented.

An embodiment of the package according to the present disclosure is characterized in that the at least one passage is located near one of the blind recesses.

Since both the recess and the passage are located near the rear of the slide so also near the rear of the housing when the slide is located inside the housing, it will be difficult for a child foresee that operations need to be performed at the rear of the housing to get the slide out of the front of the housing.

An embodiment of the package according to the present disclosure is characterized in that the top wall and the bottom wall of the housing are provided with flexible lip being pivotable with respect to the respective top wall and bottom wall, which flexible lip cooperate with the at least one extension as well as the at least one other extension respectively to move the at least one extension as well as the at least one other extension out of the corresponding recess.

The lips are located above the extensions, whereby pushing on the lips will move the extensions against spring force out of engagement of the recesses.

Another embodiment of the package according to the present disclosure is characterized in that seen in a direction perpendicular to the sliding direction and parallel to the top wall and bottom wall of the housing, the flexible lips are off set with respect to each other.

By having an off-set location of the flexible lips it will be even harder for a child to locate its fingers on the off-set lips, to operate them simultaneously, to keep pressing on the off-set lips whilst also pulling on the slide to move it out of the housing.

Another embodiment of the package according to the present disclosure is characterized in that seen in a direction perpendicular to the sliding direction and parallel to the top wall and bottom wall of the housing, the at least one extension as well as the at least one other extension are off set with respect to each other.

This makes it easier to provide the slide with extensions directed to the top wall and the bottom wall. Furthermore, in case that the extensions cooperate with the off-set lips, the off-set of the extensions and the lips will be substantially the same or at least so that each lip can cooperate with the corresponding extension.

Another embodiment of the package according to the present disclosure is characterized in that the top wall and/or the bottom wall are provided with flaps folded inside the housing, which flaps are located seen in the sliding direction near a front side of the housing, whereby the flaps cooperate with the at least one extension of the slide and/or the at least one other extension of the slide respectively to prevent the slide from being completely slide out of the housing.

It is a requirement in many countries that a slide containing drugs may not be detached from its housing. By using the extensions already present on the slide for locking the slide with respect to the housing also for preventing the slide from being completely slide out of the housing, no additional extensions are needed on the slide.

Another embodiment of the package according to the present disclosure is characterized in that the housing and/or slide are made of a carton blank or plastic.

Such materials are suitable for making disposable packages.

Another embodiment of the package according to the present disclosure is characterized in that the housing is made of a carton blank whereby after folding of the blank into the housing, the top wall and the bottom wall each comprises at least two parts of the blank located on top of each other, whereby the part directed to the inside of the housing is provided with the recess.

By having two parts of the blank located on top of each other and preferably connected to each other a sturdy top wall and bottom wall are obtained. Furthermore, by proving the part directed to the inside of the housing with the recess, the part directed to the outside of the housing will cover the recess so that in a simple manner a blind recess is obtained. Such blind recess is not visible nor accessible from the outside of the housing.

Another embodiment of the package according to the present disclosure is characterized in that at least the part directed to the outside of the housing is provided with the flexible lip.

By means of the flexible lip the extension can be pushed out of engagement of the recess. Such lip can easily be provided in the blank.

Another embodiment of the package according to the present disclosure is characterized in that the part directed to the inside of the housing is also provided with the flexible lip, whereby the flexible lips of the parts directed to the outside and inside of the housing are connected to each other, whereby the flexible lip of the part directed to the inside of the housing is larger that the flexible lip of the part directed to the outside of the housing.

By having the lip made of parts directed to the outside and inside of the housing, a strong flexible lip is obtained. By making the flexible lip of the part directed to the inside of the housing larger that the flexible lip of the part directed to the outside of the housing, the flexible lip can only be moved into the housing but not out of the housing. This has the advantage that the lip can not be torn of the housing. Another advantage is that it will prevent full access to the passage through which the flexible lip is movable with respect to the top wall and bottom wall.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIGS. 2A-2K are perspective views of the making of a slide of the package according to the first embodiment of the present disclosure.

DETAILED DESCRIPTION

Figure 1A:
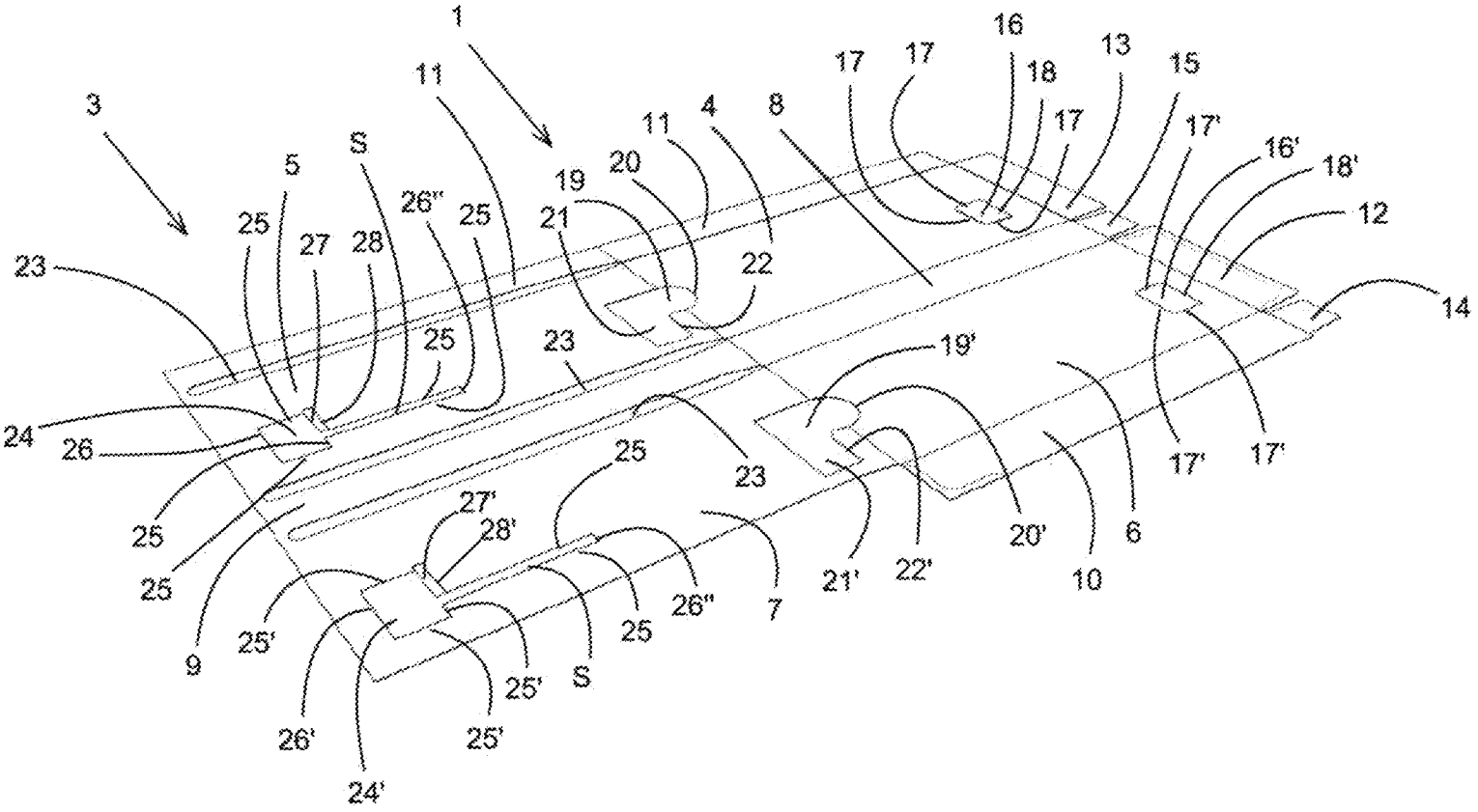
FIGS. 1A-1G are perspective views of the making of a housing of a package according to a first embodiment of the present disclosure.

FIGS. 1A-1G are perspective views of the making of a housing 1 of a package 2 according to a first embodiment of the present disclosure.

The housing 1 is made from a blank 3 made of carton. The blank 3 comprises cut away parts, parts interconnected by folding lines and cut through lines.

The blank 3 comprises an outer top wall part 4, an inner top wall part 5, an outer bottom wall part 6, an inner bottom wall part 7, a first outer side wall part 8, a first inner side wall part 9, a second outer side wall part 10, a second inner side wall parts 11, a first rear wall part 12, a second rear wall part 13, a third rear wall part 14 and a fourth rear wall part 15.

The outer top wall part 4 is connected by folding lines at its four edges to the inner top wall part 5, the first outer side wall part 8, the second inner side wall parts 11, the second rear wall part 13. The outer top wall part 4 is provided with a flexible lip 16 made by three cut through lines 17 and only connected at a folding line 18 to the outer top wall part 4.

The outer top wall part 4 and the inner top wall part 5 are provided with a cut a way part 19 providing the outer top wall part 4 with a semi-circular gripping opening 20 and providing the inner top wall part 5 with a secondary recess 21 having an edge 22.

The inner top wall part 5 is connected at ends of cut through parts to the first inner side wall part 9 and the second inner side wall part 11. The inner top wall part 5 is provided with a flexible lip 24 made by cut through lines 25 and connected at a first end at a folding line 26 and at a second end via a flexible strip S at a folding line 26" to the inner top wall part 5.

The inner top wall part 5 is provided with a cut a way part providing the inner top wall part 5 with a primary recess 27 having an edge 28.

The outer bottom wall part 6 is connected by folding lines at its four edges to the inner bottom wall part 7, the outer side wall parts 8, 10 and the rear wall part 12. The outer bottom wall part 6 is provided with a flexible lip 16' made by three cut through lines 17' and only connected at a folding line 18' to the outer bottom wall part 6.

The outer bottom wall part 6 and the inner bottom wall part 7 are provided with a cut a way part 19' providing the outer bottom wall part 6 with a semi-circular gripping opening 20' and providing the inner bottom wall part 5' with a secondary recess 21' having an edge 22'.

The inner bottom wall part 7 is connected at an end of cut through part to the first inner side wall part 9. The inner bottom wall part 7 is provided with a flexible lip 24' made by cut through lines 25' and connected at a folding line 26' to the inner bottom wall part 7 and at a second end via a flexible strip S at a folding line 26" to the inner bottom wall part 7.

Figure 1B:
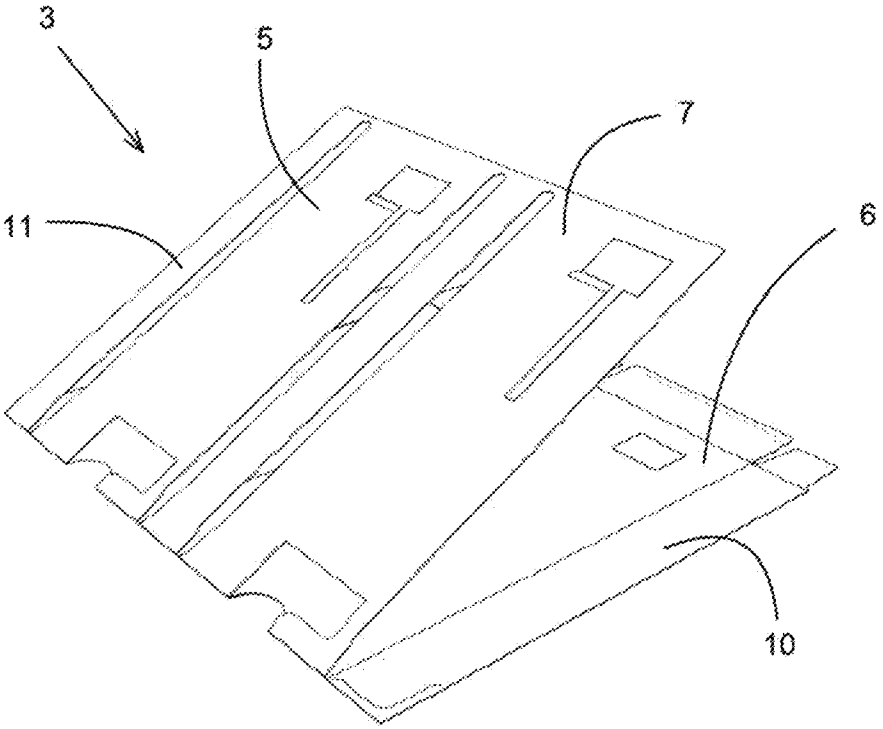
Figure 1C:
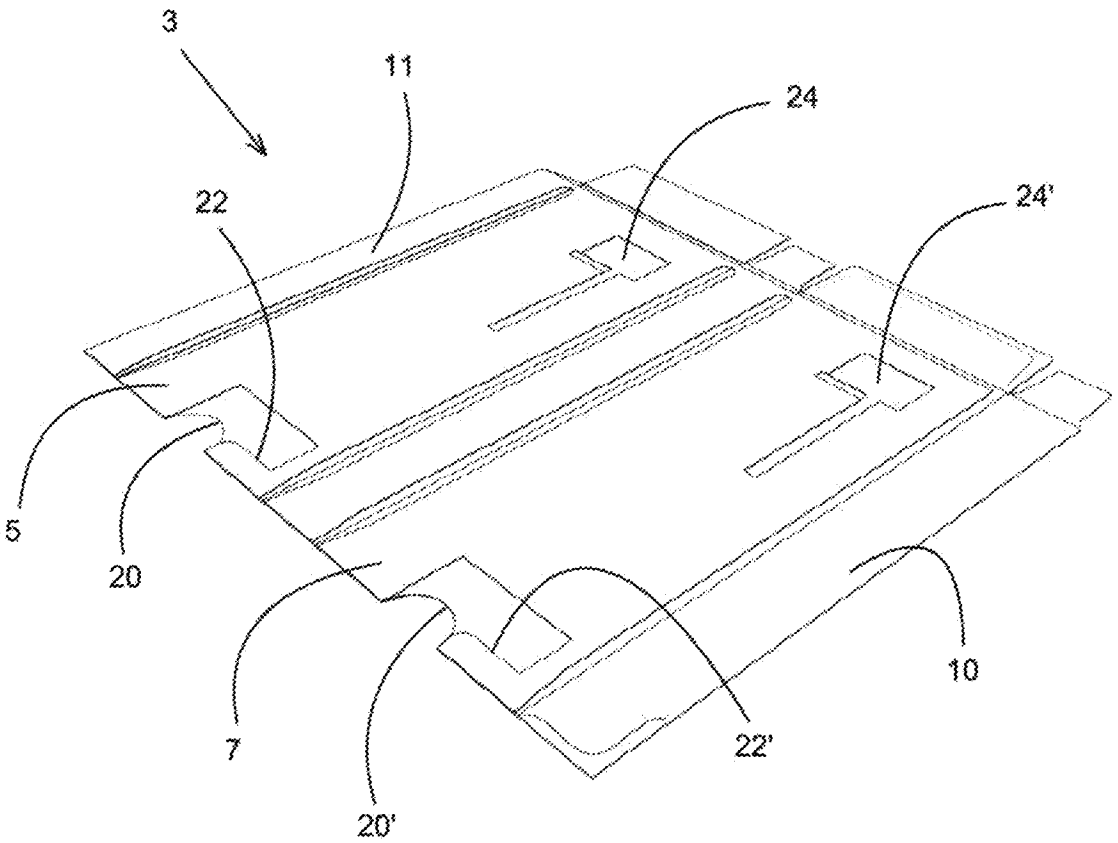
Figure 1D:
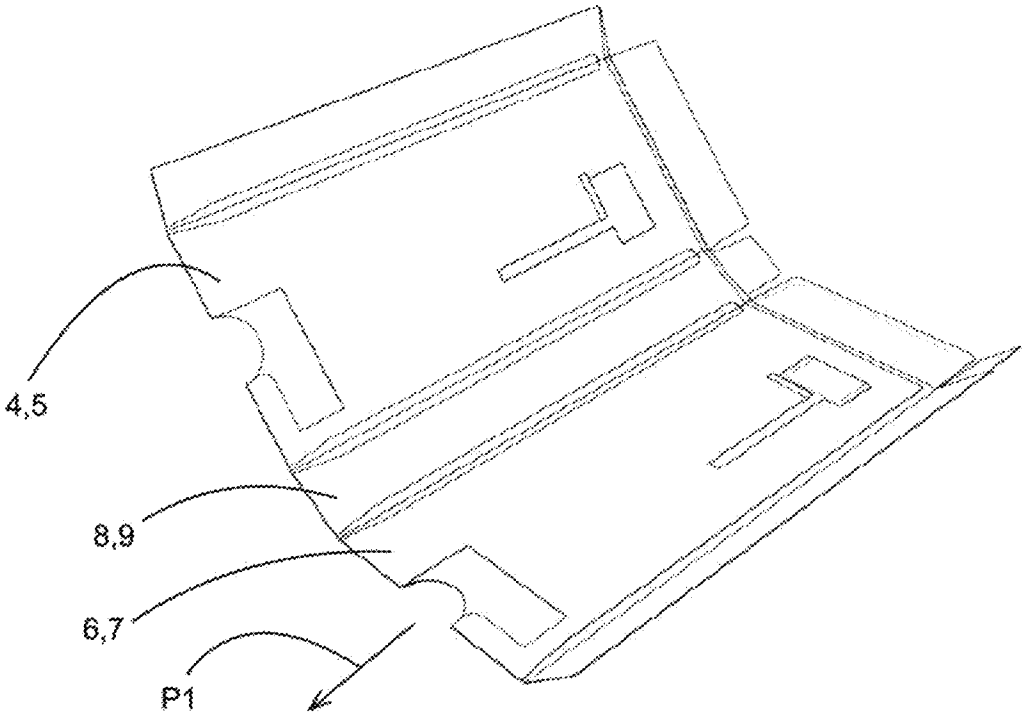
Figure 1E:
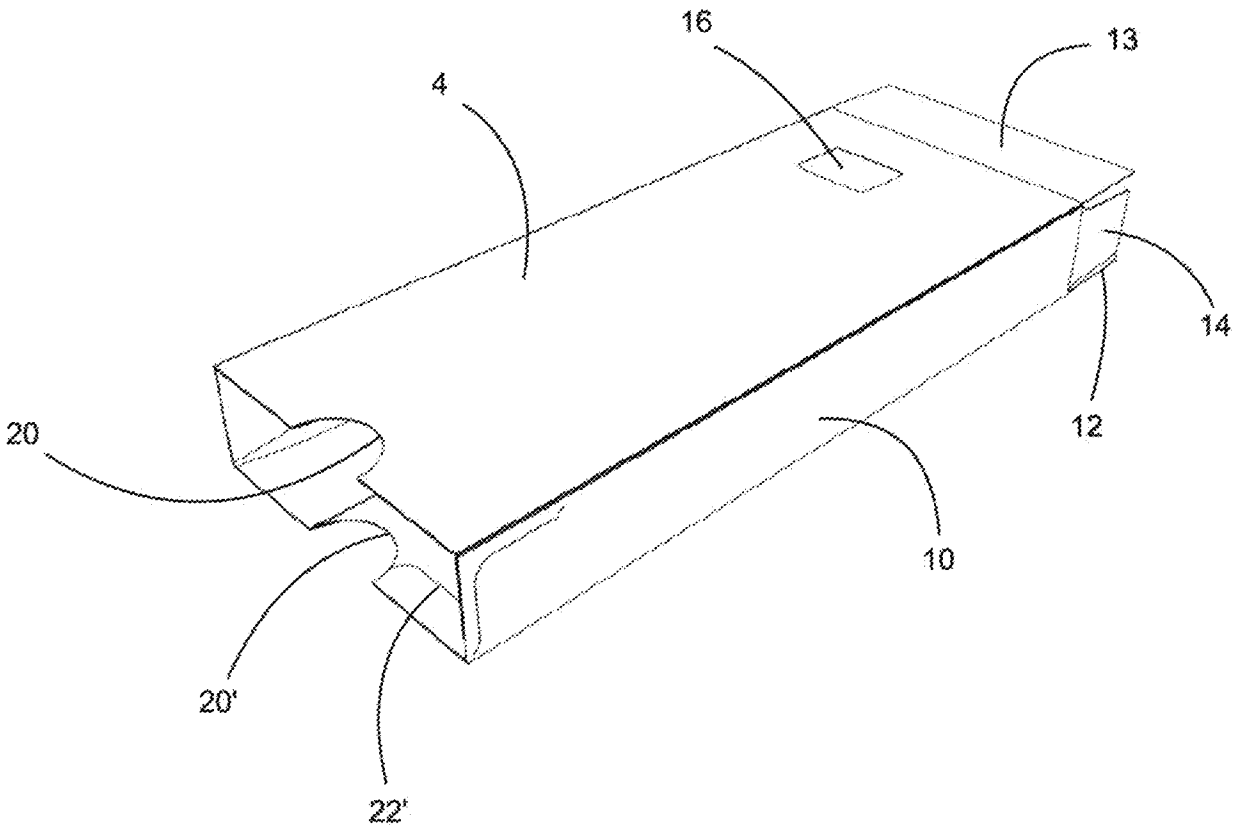
Figure 1F:
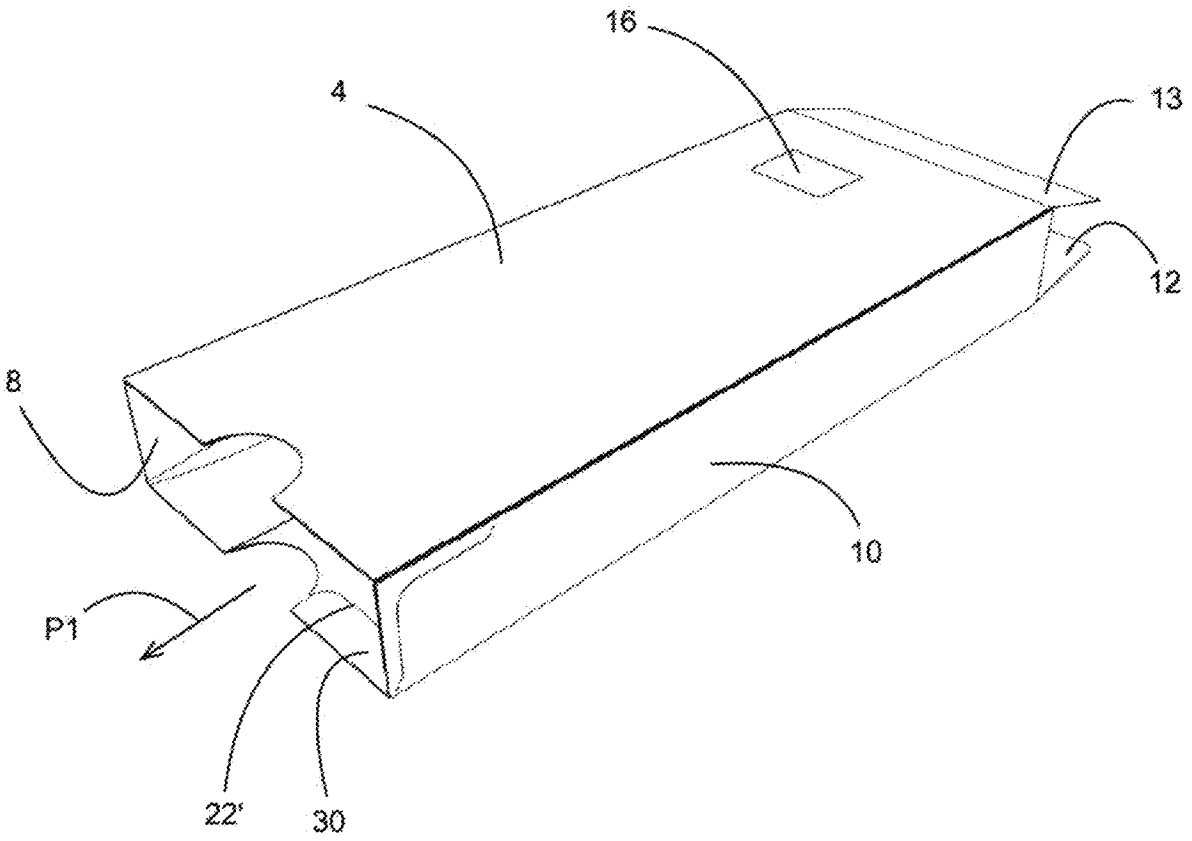
Figure 1G:
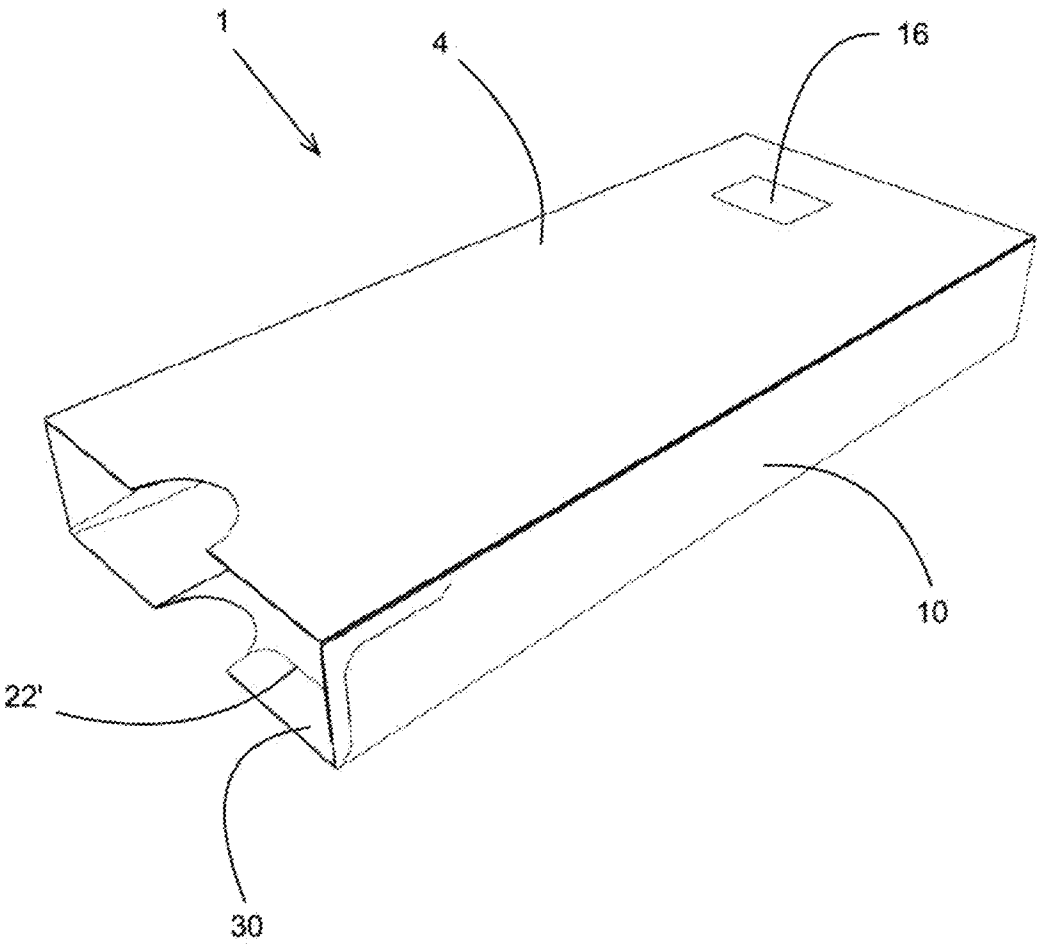

Starting from the blank 3 and shown in FIG. 1A, the housing as shown in FIG. 1G is obtained by folding the parts with respect to each other and connecting some of the parts to each other in the following manner.

FIG. 1B shows pivoting the inner wall part 5,7 and inner side wall part 11 with respect to the outer walls part 4, 6 till the position as shown in FIG. 1C has been reached. The inner wall part 5,7 are being glued to the respective outer walls part 4, 6.

Subsequently, as shown in FIG. 1D the parts are folded over folding lines extending parallel to the sliding direction as indicated by arrow P1 till the position as shown in FIG. 1E has been reached.

The inner side wall parts 11 are being glued to the outer side wall part 10.

Subsequently, as shown in FIG. 1F the first rear wall part 12, the second rear wall part 13, the third rear wall part 14 and the fourth rear wall part 15 are folded and connected to each other to form a closed rear end of the housing 1 as shown in FIG. 1G.

As can be seen in FIG. 1G the front end of the housing 1 is open. Near the open front end, the housing 1 is provided with flaps 30 provided with the edges 22, 22'.

FIGS. 2A-2K are perspective views of the making of a slide 41 of a package 2 according to a first embodiment of the present disclosure.

The slide 41 is made from a blank 42 made of carton. The blank 3 comprises cut away parts, parts interconnected by folding lines and cut through lines.

Figure 2A:
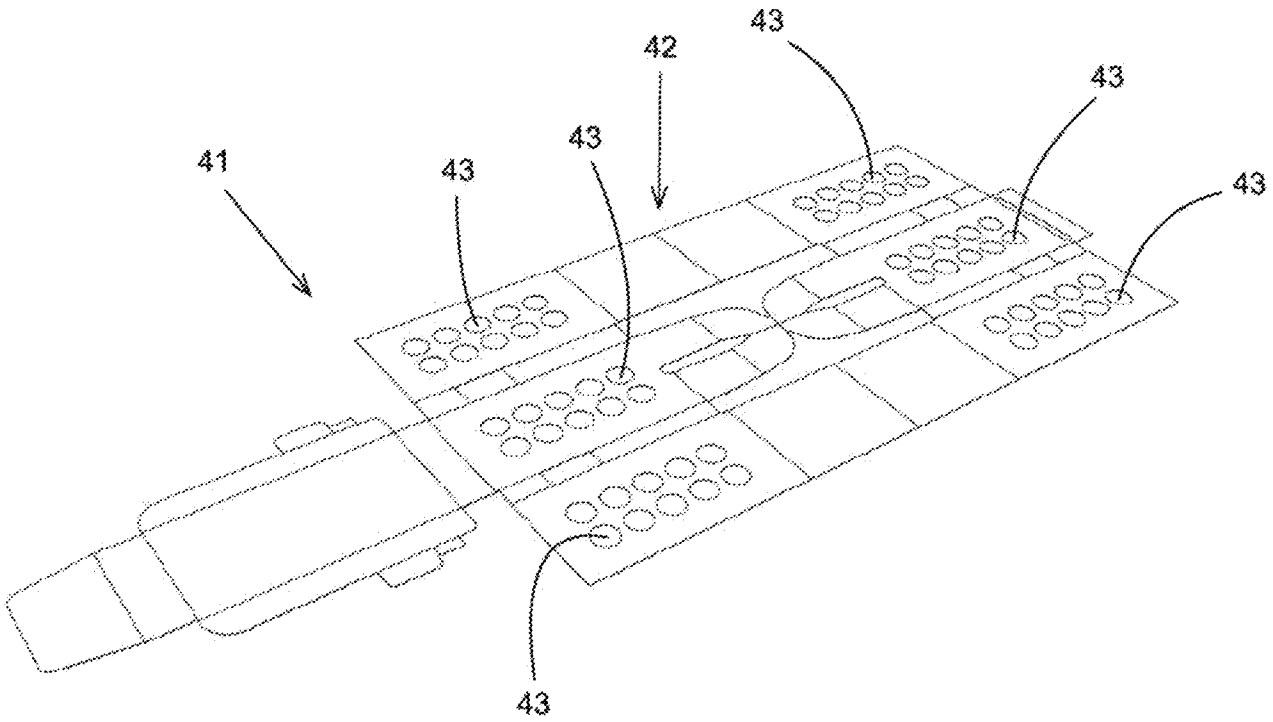

FIG. 2*a* shows the flat blank 42 provided amongst others with six parts provided with arrays of holes 43.

Figure 2B:
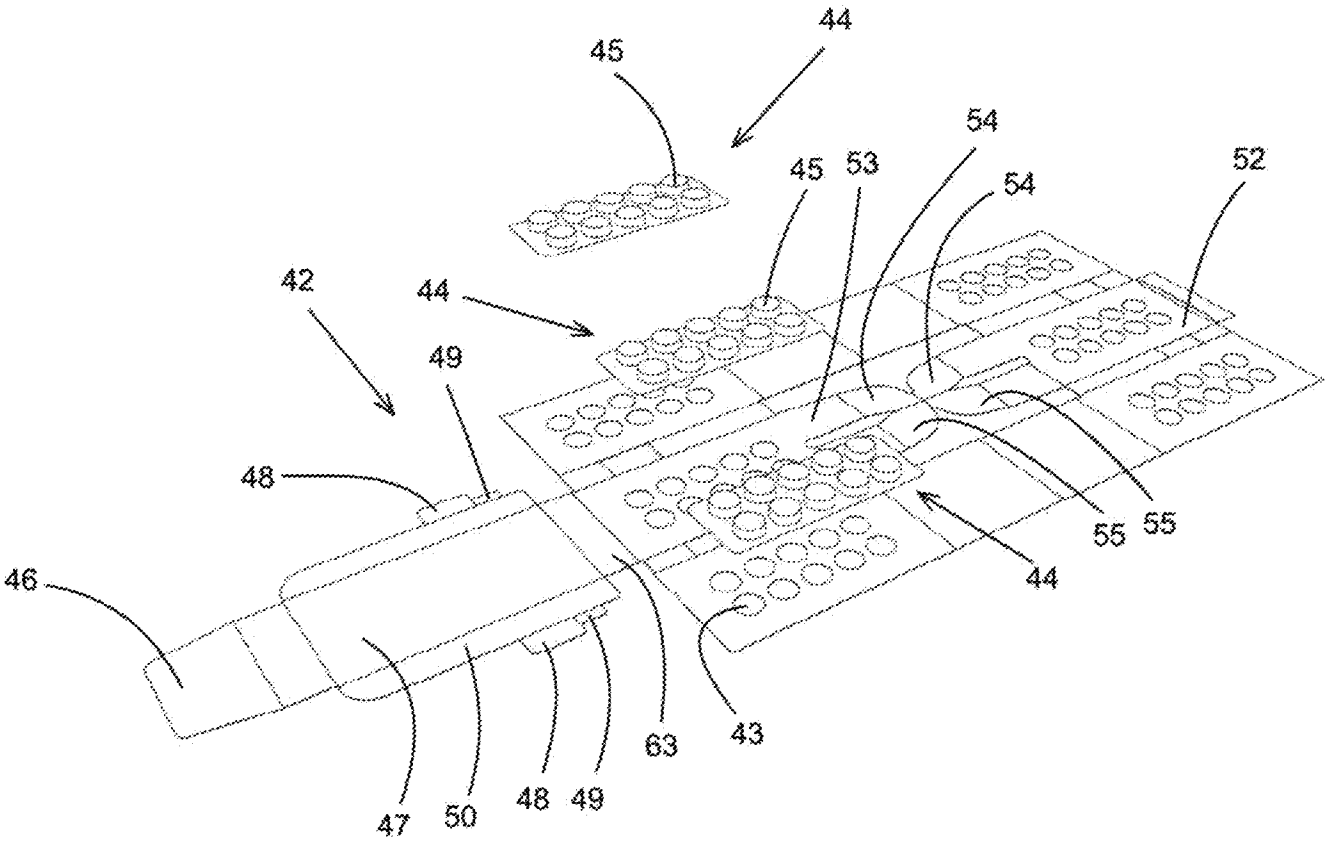

FIG. 2B shows the blank 42 whereby three blisters 44 with tablets located inside pockets 45 of the blisters 44 are positioned on top of three parts provided with holes 43. The pockets 45 are located in the same arrays as the arrays of holes 43.

Figure 2C:
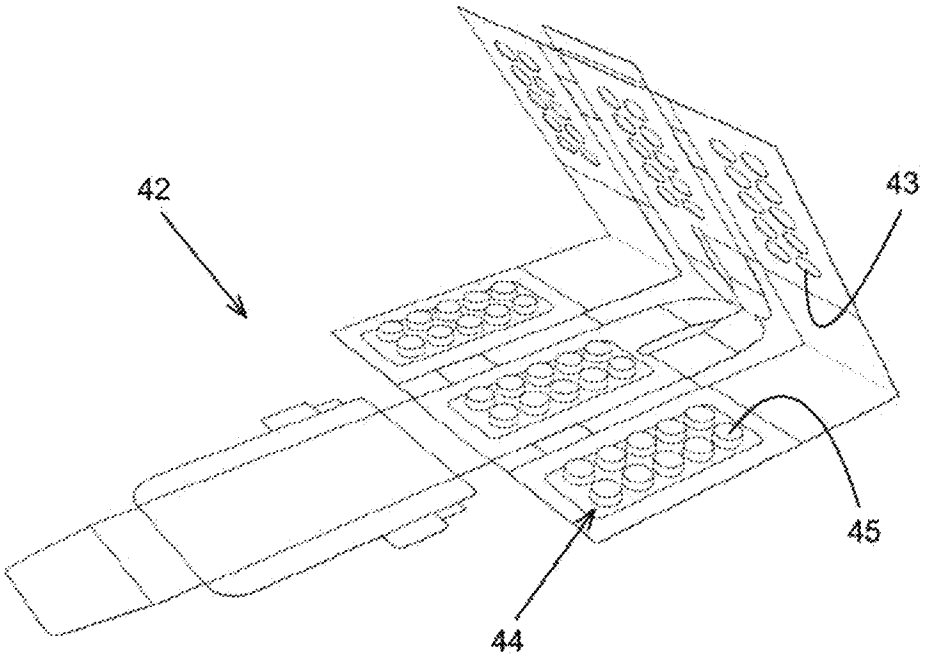

FIG. 2C shows that the blank 42 is folded over a folding line whereby the holes 43 in the other three parts are positioned over the pockets 45 of the blisters 44.

Figure 2D:
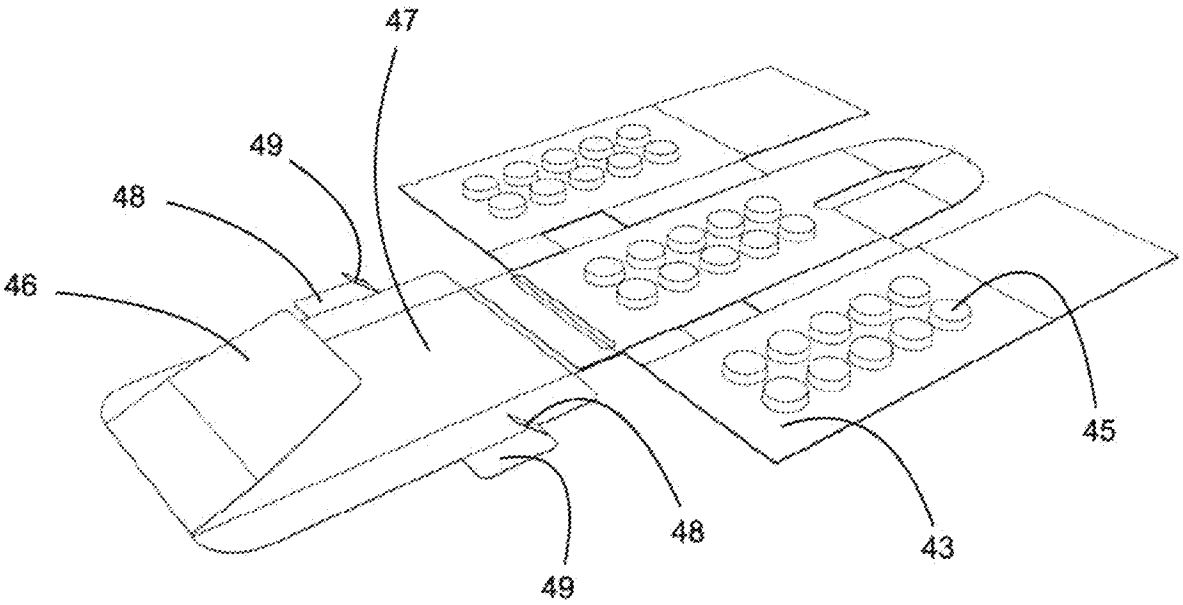

FIG. 2D shows that the parts with the holes 43 are glued together whereby the blisters 44 are locked between the glued together parts.

Figure 2E:
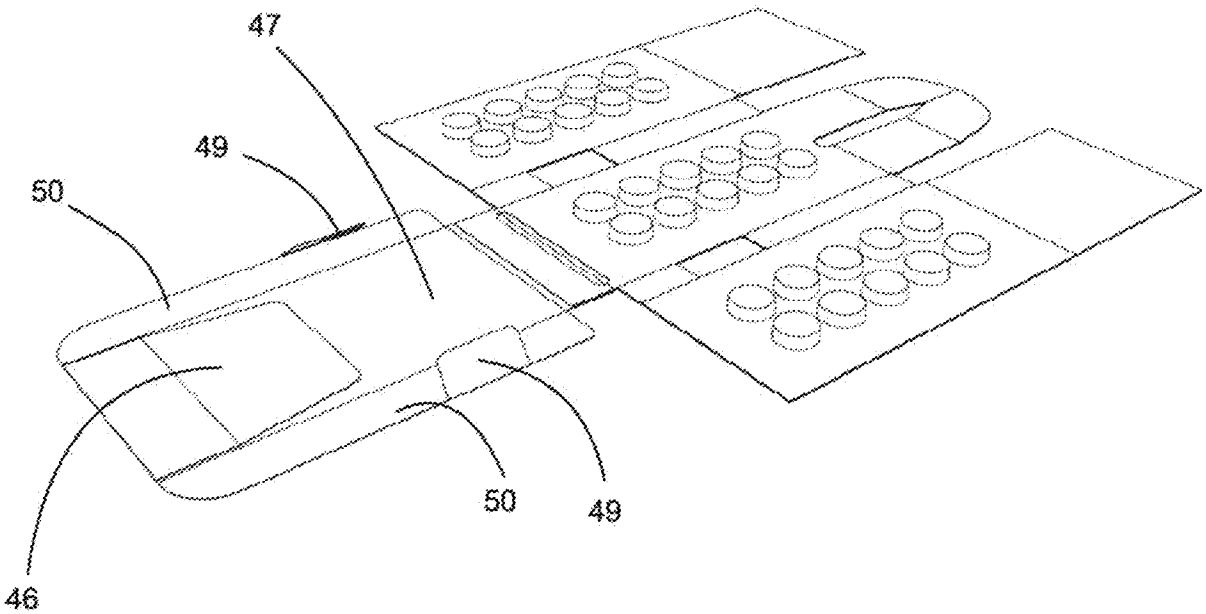

Furthermore, part 46 is folded on top of part 47 and the parts 48 are folded on top of parts 49 to the position as shown in FIG. 2E.

Figure 2F:
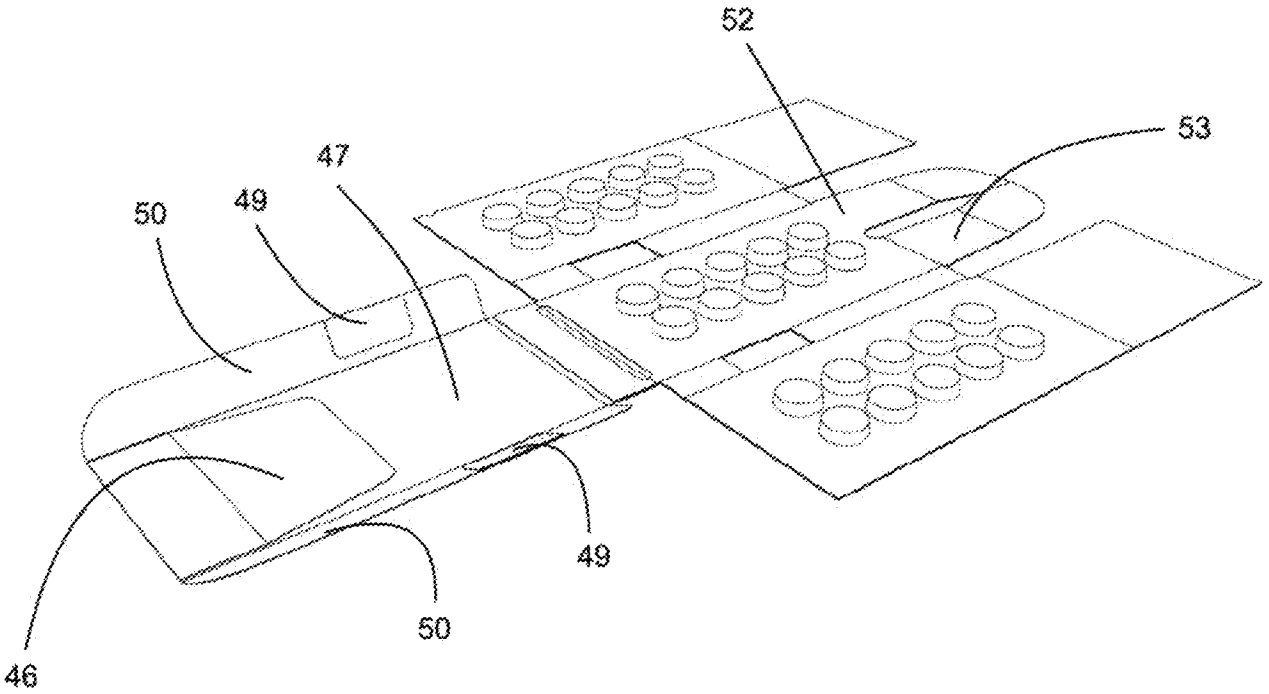

Subsequently parts 49 are folded on side parts 50 and the side parts 50 are folded with respect to part 47 to the position as shown in FIG. 2F.

Figure 2G:
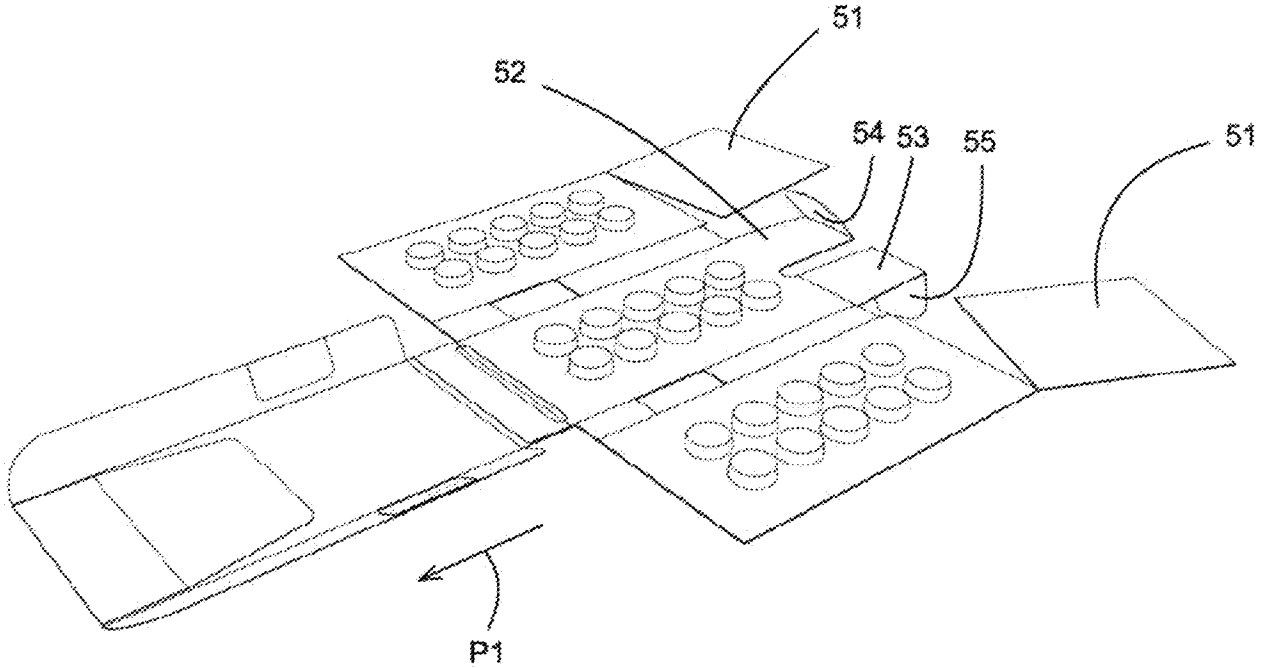
Figure 2H:
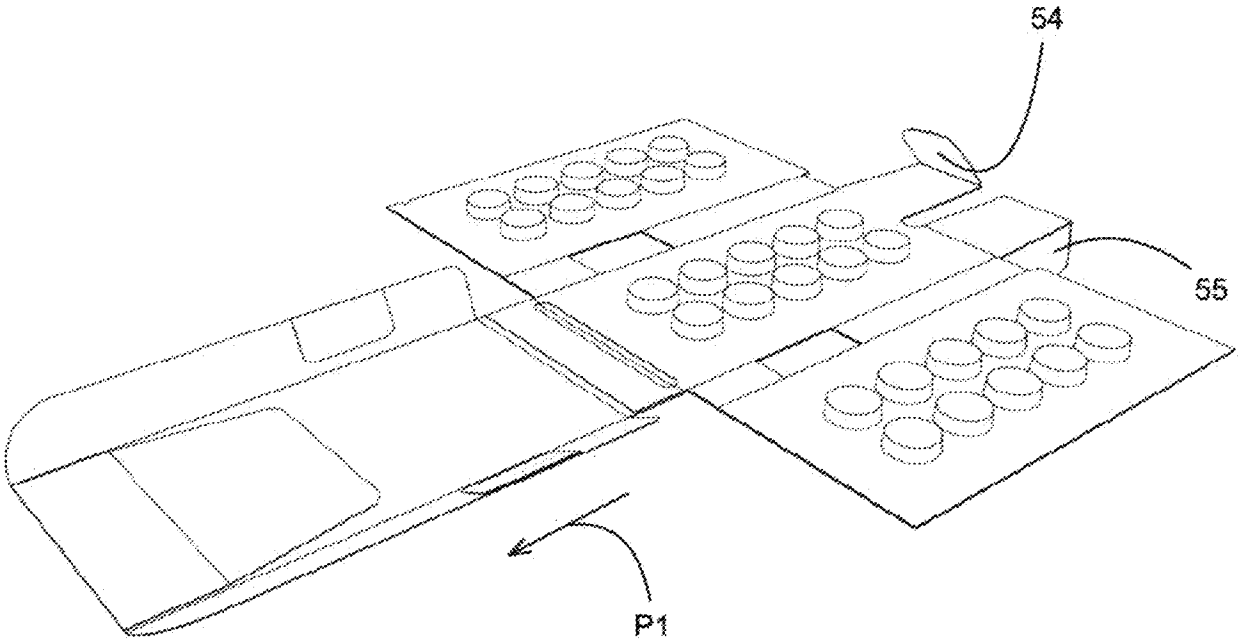

Subsequently, parts 51 are cut off the folded blank as can be seen in FIG. 2G. As also shown in FIGS. 2G and 2H is that the parts 52, 53 with the centrally located blister 44 is provided with extensions 54, 55. One extension 54 is folded upwards and the other extension is folded downwards. Seen in a direction perpendicular to the sliding direction as indicated by arrow P1 and in the plane of the parts 52, 53, the extensions 54, 55 are off-set.

Figure 21:
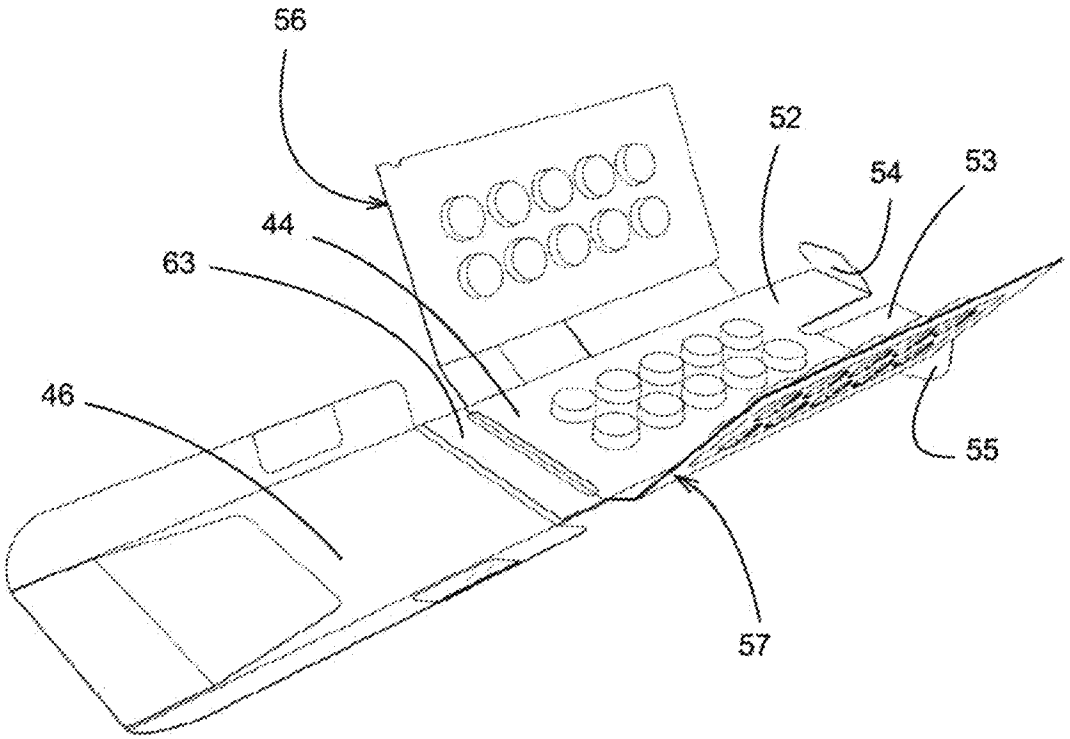

Subsequently the parts 56, 57 with the outer blisters 44 are folded onto the parts 52, 53 with the centrally located blister 44, see FIG. 21.

A cover 60 comprising the parts 46-50 is folded over the stacked blisters 44. The parts 48, 49 of the side parts 50 will lock into openings 61 of walls 62 connecting the parts 52, 53 with the outer parts 56, 67. A wall 63 located between the part 46 and the part 53 will form a closure wall of the front opening of the housing 1 when the slide 41 is located inside the housing 1.

Figure 2J:
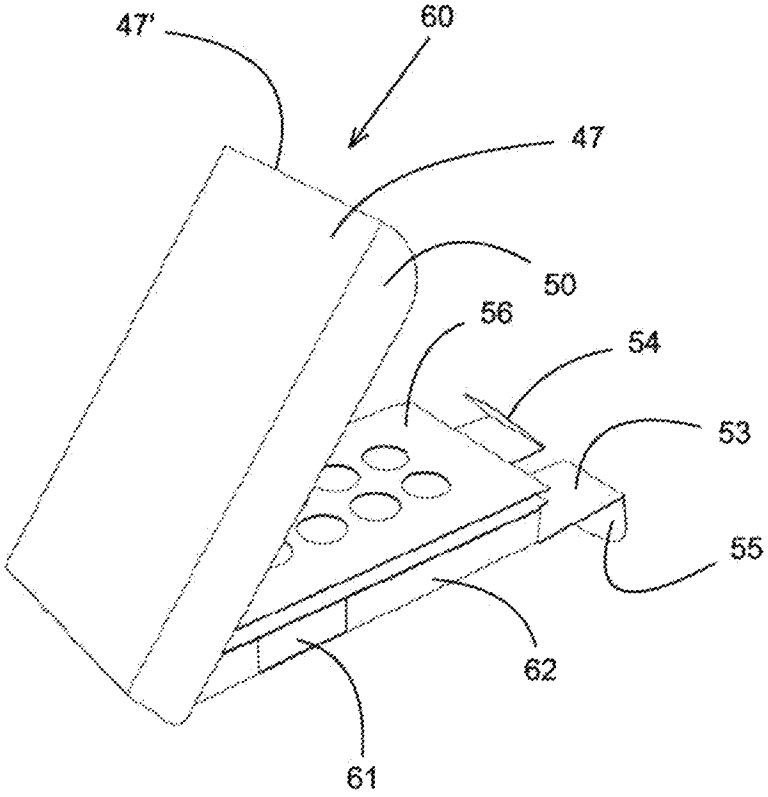
Figure 2K:
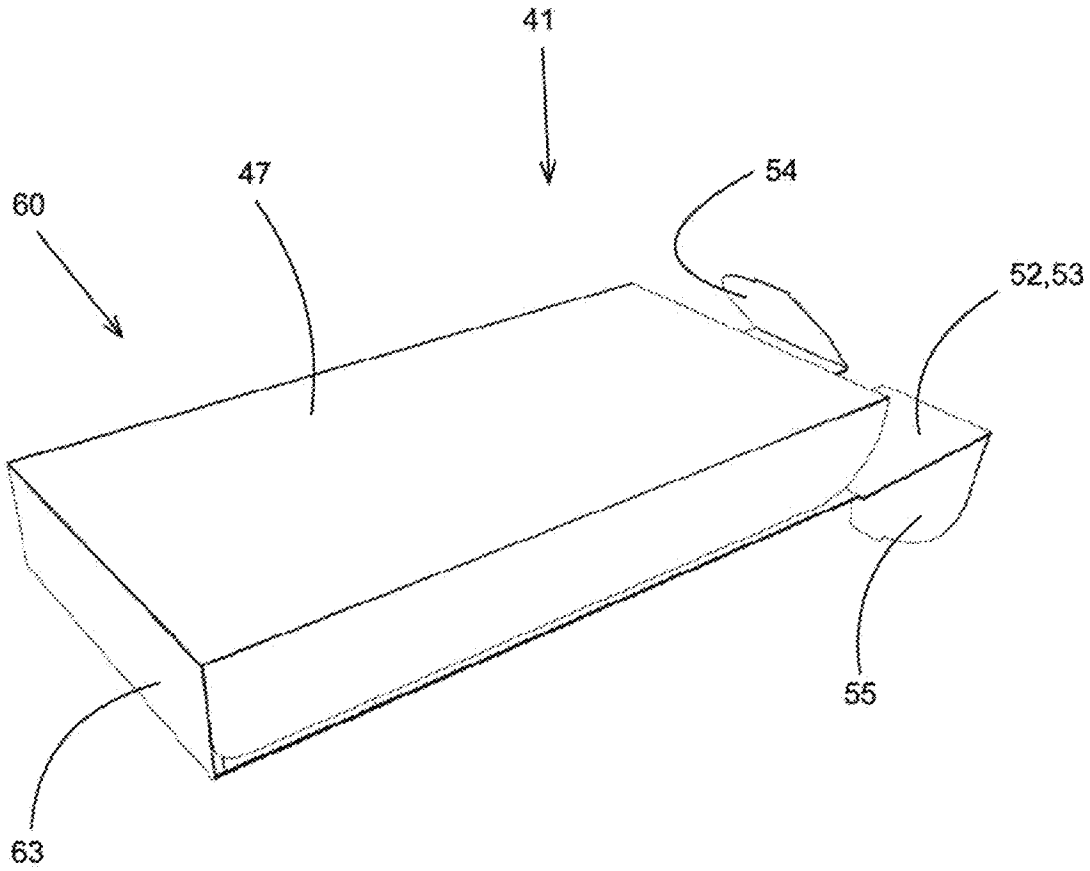

The complete slide 41 with the blisters 44 located inside the slide 41 is shown in FIG. 2K.

Figures 3A, 3B, 3C:
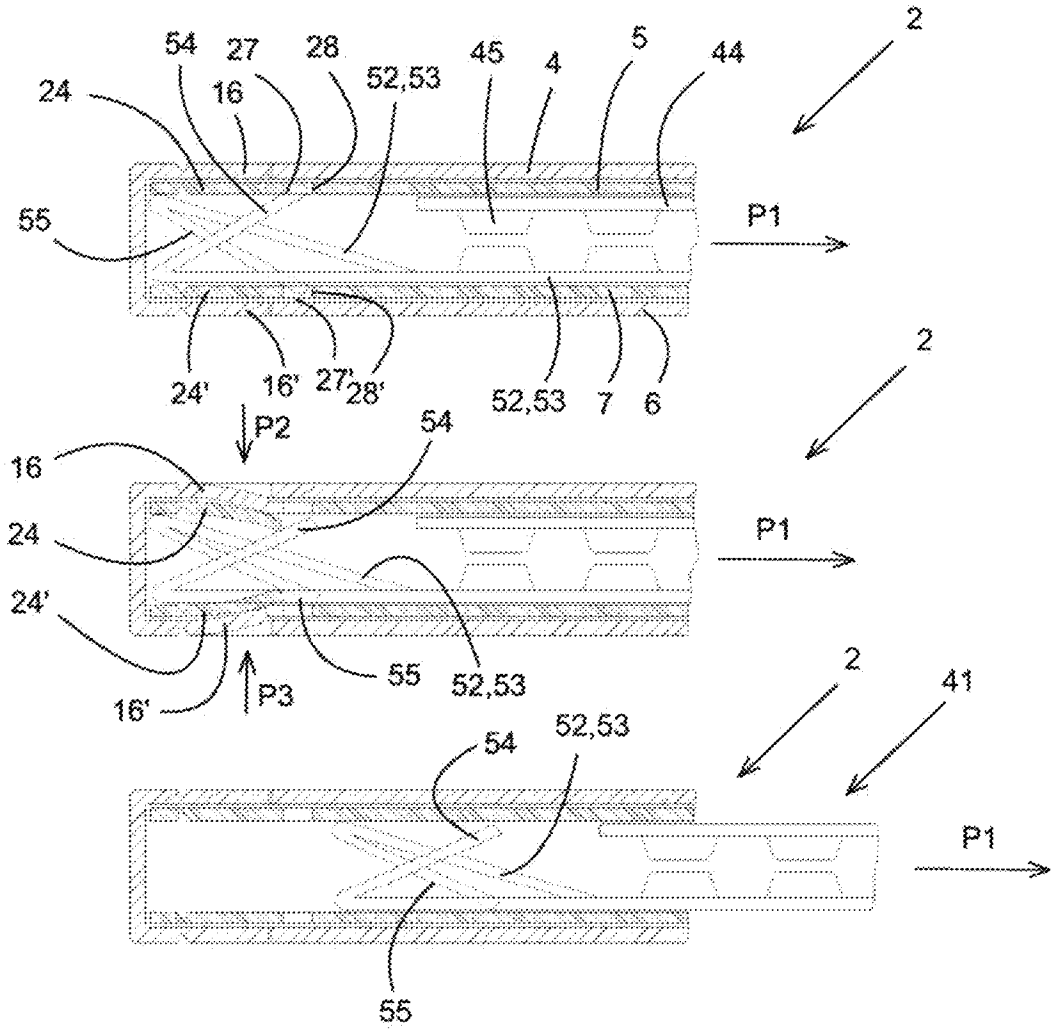
FIGS. 3A-3C are cross section of the package comprising the housing as shown in the FIGS. 1A-1G and a slide shown in the FIGS. 2A-2K, respectively in a locked position, un unlocked position and an intermediate position.
Figure 4A:
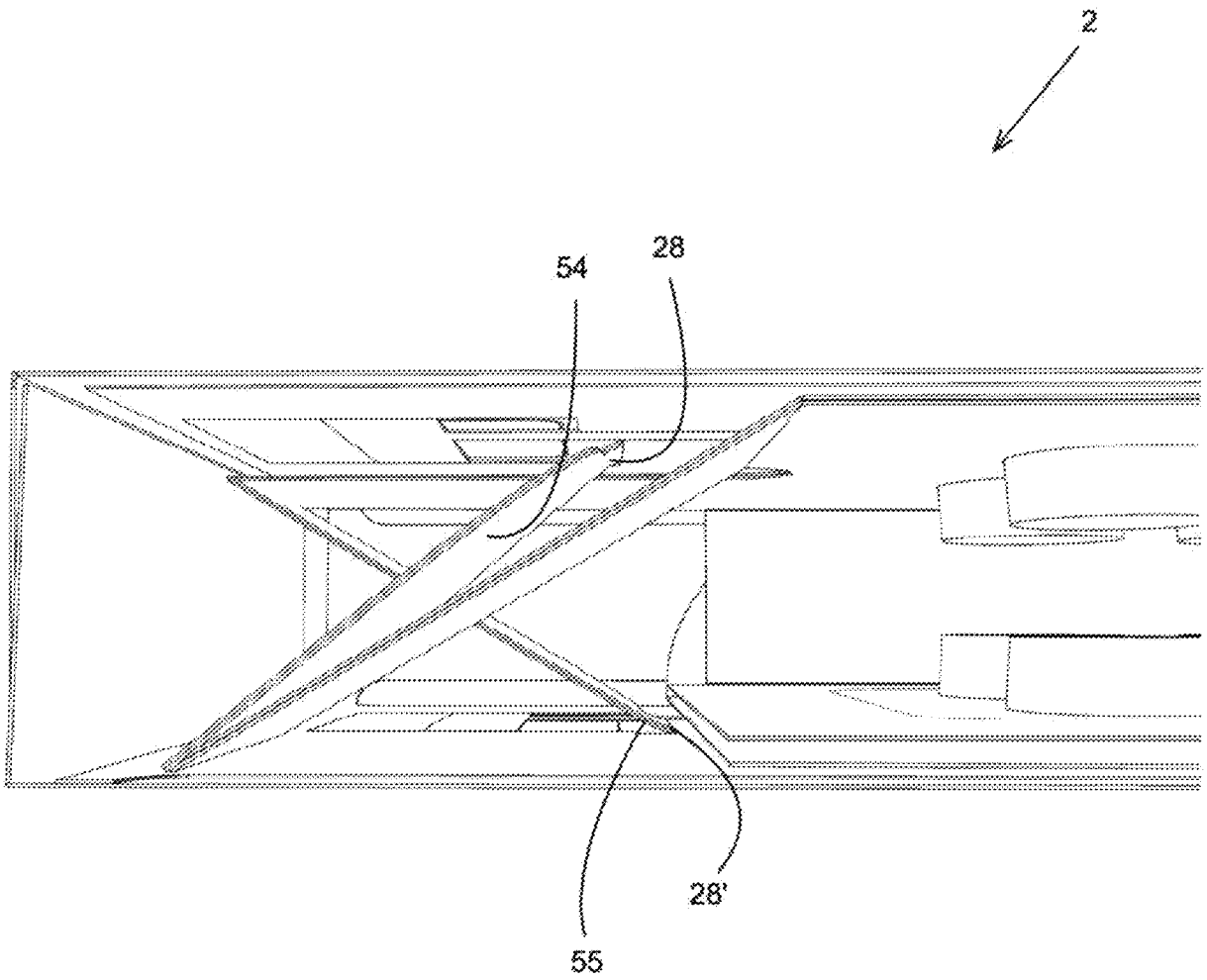
FIGS. 4A-4D are perspective views of the package comprising the housing as shown in the FIGS. 1A-1G and a slide shown in the FIGS. 2A-2K, respectively in a locked position, un unlocked position, a first and second end position.

FIGS. 3A and 4A show a cross section and perspective view of the package 2 comprising the housing 1 as shown in the FIGS. 1A-1G and the slide 41 shown in the FIGS. 2A-2K in a locked position, whereby the slide 41 comprises two instead of blisters 44. It is also possible that the slide 41 comprises only blister 44.

In the locked position the extensions 54, 55 are located in the recesses 27, 27' respectively and abut against edges 28, 28'.

Figure 4B:
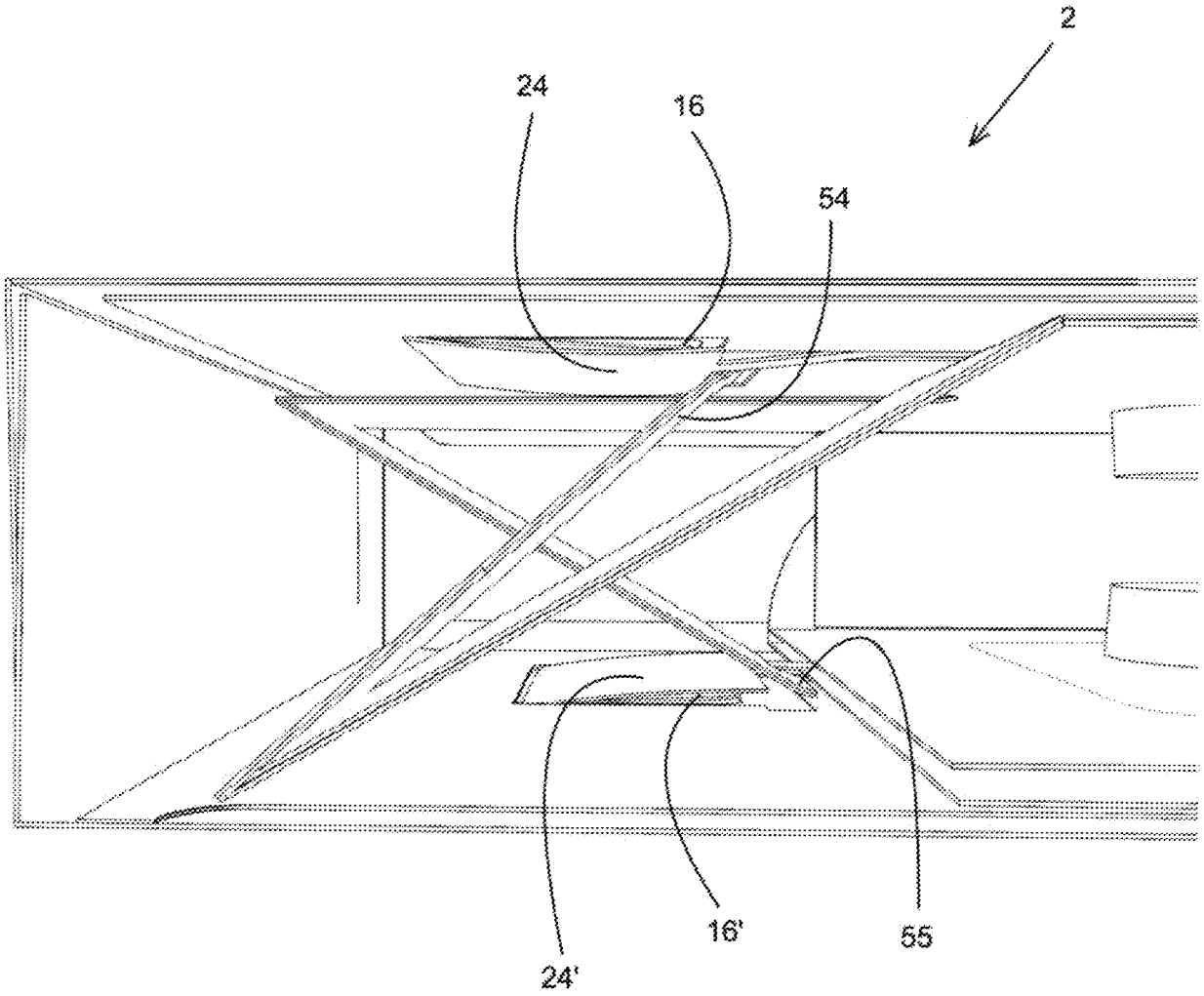

FIGS. 3B and 4B show a cross section and perspective view of the package 2 comprising the housing 1 as shown in the FIGS. 1A-1G and the slide 41 shown in the FIGS. 2A-2K in an unlocked position.

A user pushes on the flexible lips made of the parts 16,24 and 16',24' in the directions as indicated by arrows P2, P3 extending in a direction perpendicular to the sliding direction as indicated by arrow P1 and perpendicular to the planes of the top wall 4, 5 and the bottom wall 6, 7. The extensions 54, 55 are moved out of the recesses 27, 27' and out of engagement with the edges 28, 28'.

Subsequently as shown in FIG. 3C the slide 41 can be moved in the sliding direction by pulling on a part of the slide 41 accessible via the semi-circular gripping openings 20, 20'.

Figure 4C:
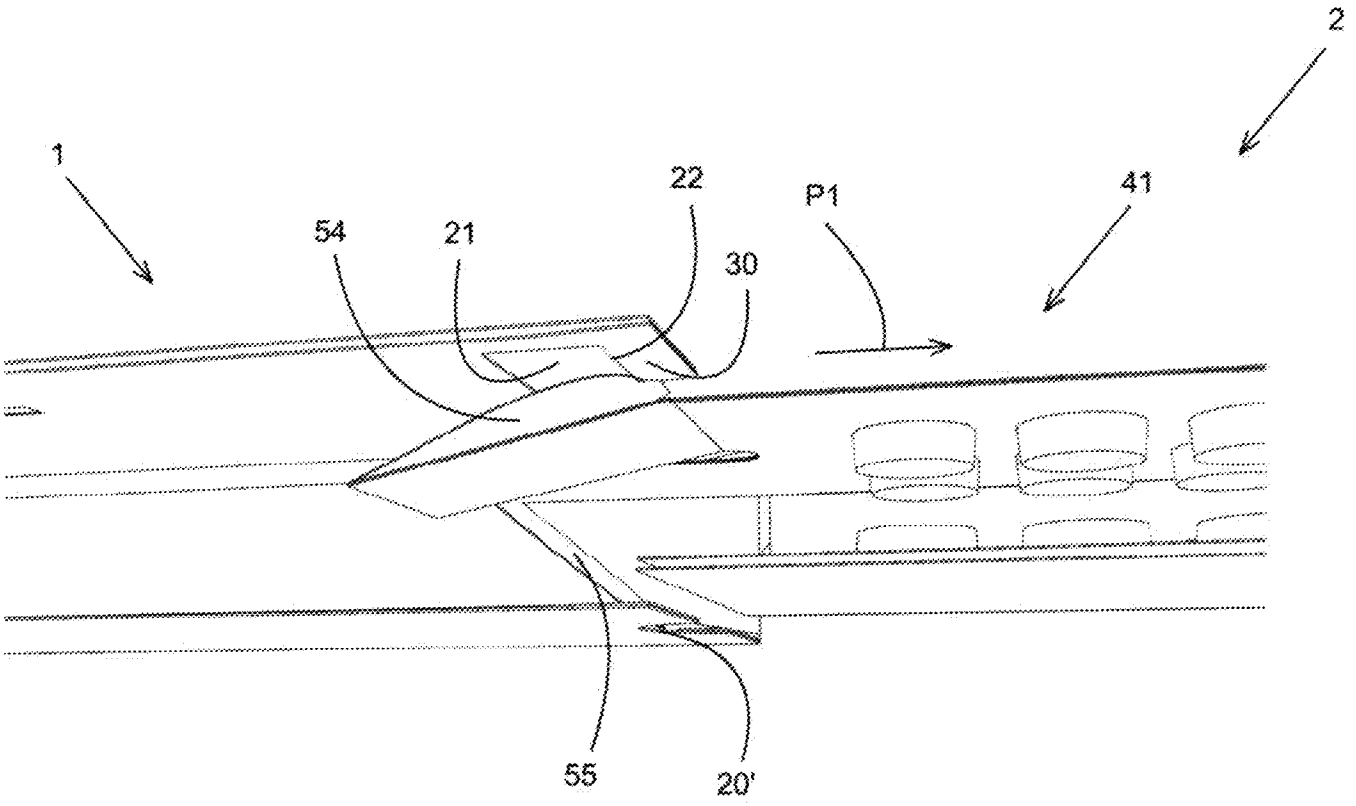
Figure 4D:
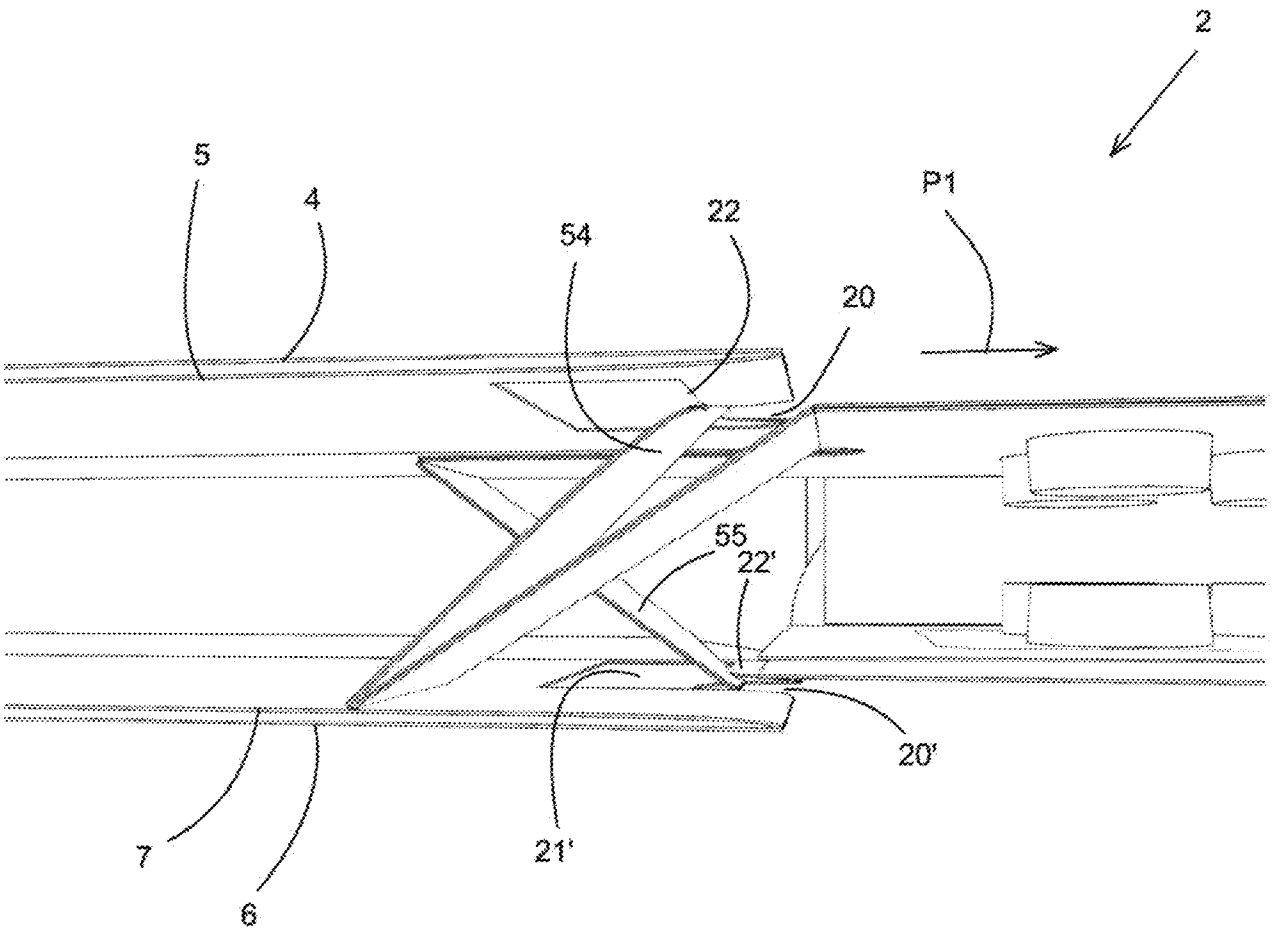

FIGS. 4C and 4D are perspective views of the package 2 with the g the housing 1 and the slide 41 shown in a first and second end position.

In the first end position the slide 41 is moved out of the housing 1 till the end of extension 54 moves under spring force of the extension 54 itself into the recess 21 until it abuts against edge 22. The same happens with extension 55. It moves under spring force of the extension 55 itself into the recess 21' until it abuts against edge 22'. The slide 41 is thereby prevented from moving out of the housing. 1.

In the second end position as shown in FIG. 4D the slide 41 is moved to its utmost end position whereby the ends of the extensions 54, 55 located remote of the edges 22, 22' firmly abut against the walls 4, 5, 6, 7 of the housing 1 and no further movement of the slide 41 out of the housing 1 is possible.

FIGS. 5A-5G are perspective views of the making of a housing 101 of a package 102 according to a second embodiment of the present disclosure. Only the differences between the making of the housing 101 with respect to the housing 1 will be described.

The housing 101 does not comprise cut a way parts 19, 19' and semi-circular gripping openings 20, 20'. It has rectangular secondary recesses 121, 121' located at a distance of outer rims 123, 123' of the housing 101. Each rectangular secondary recesses 121, 121' has an edge 122, 122'.

The housing 101 has in addition oval passages 124, 124' in the outer bottom wall part 6 and the inner bottom wall part 7. The oval passages 124, 124' coincide when the outer bottom wall part 6 and the inner bottom wall part 7 are located on top of each other. What is called "bottom" and "top" in the description can of course also be reversed depending on the desires orientation of the package.

Figure 5A:
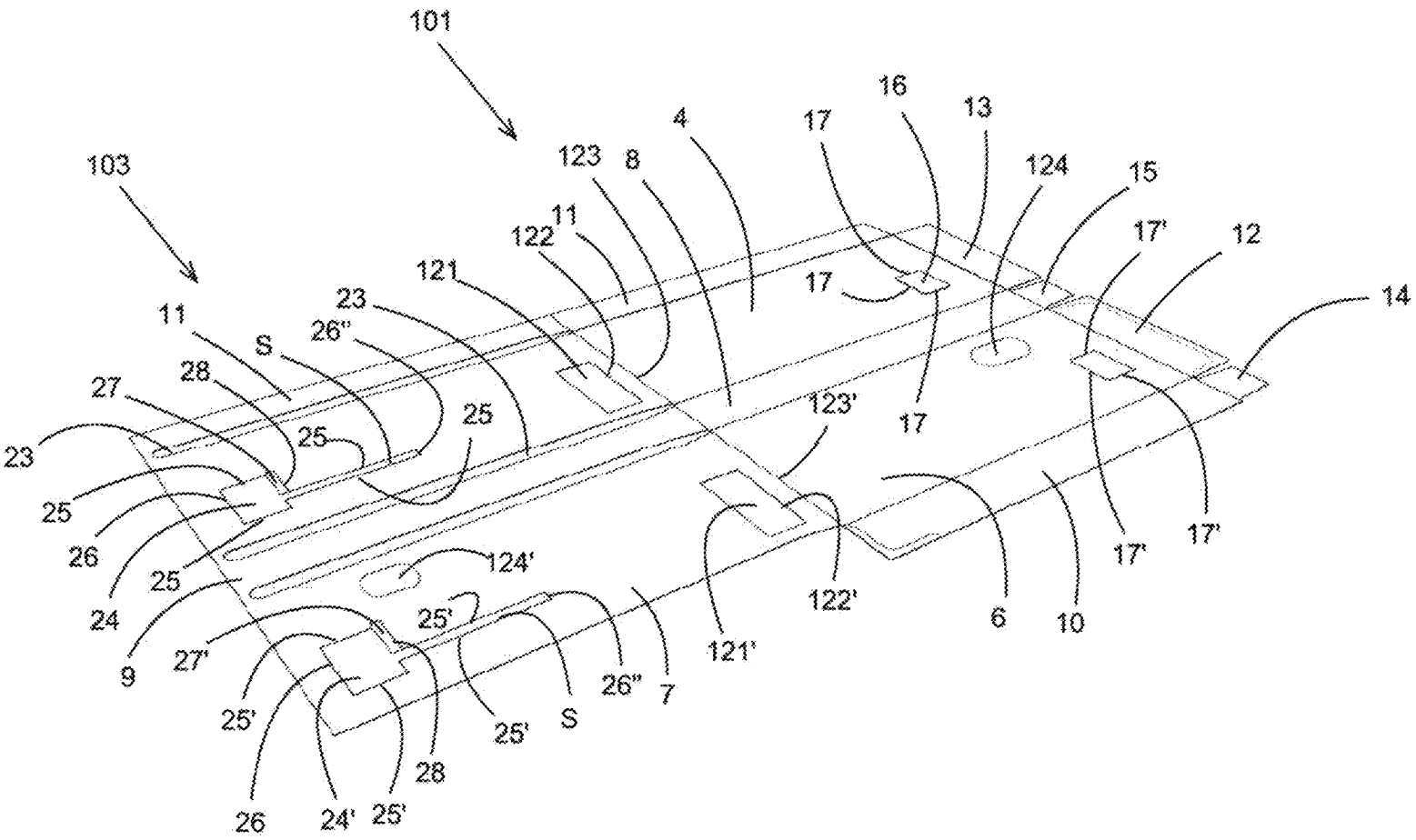
FIGS. 5A-5G are perspective views of the making of a housing of a package according to a second embodiment of the present disclosure.
Figure 5B:
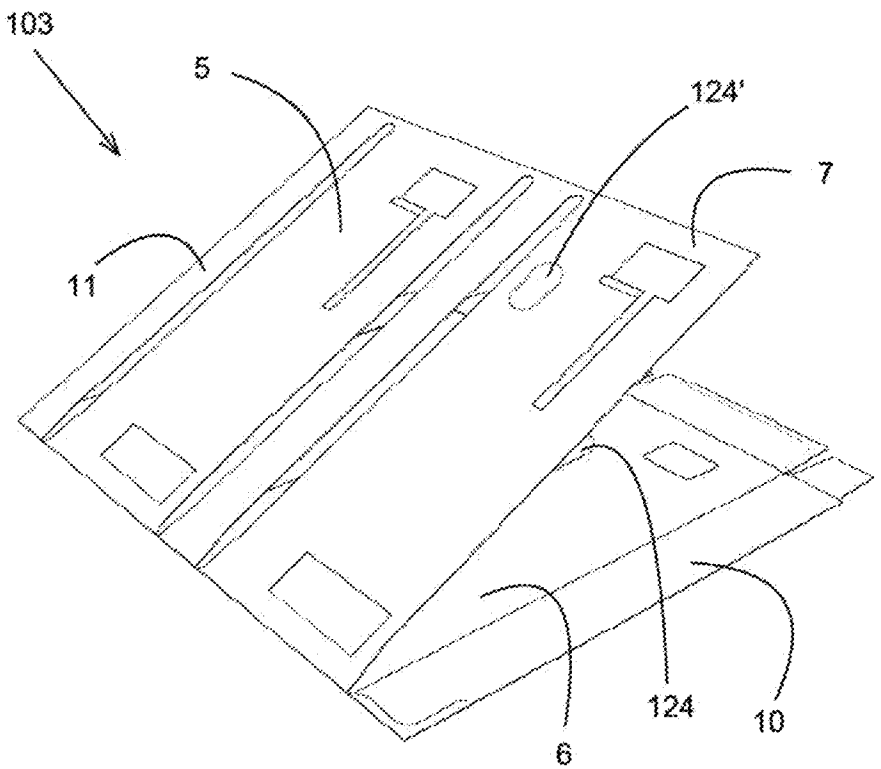
Figure 5C:
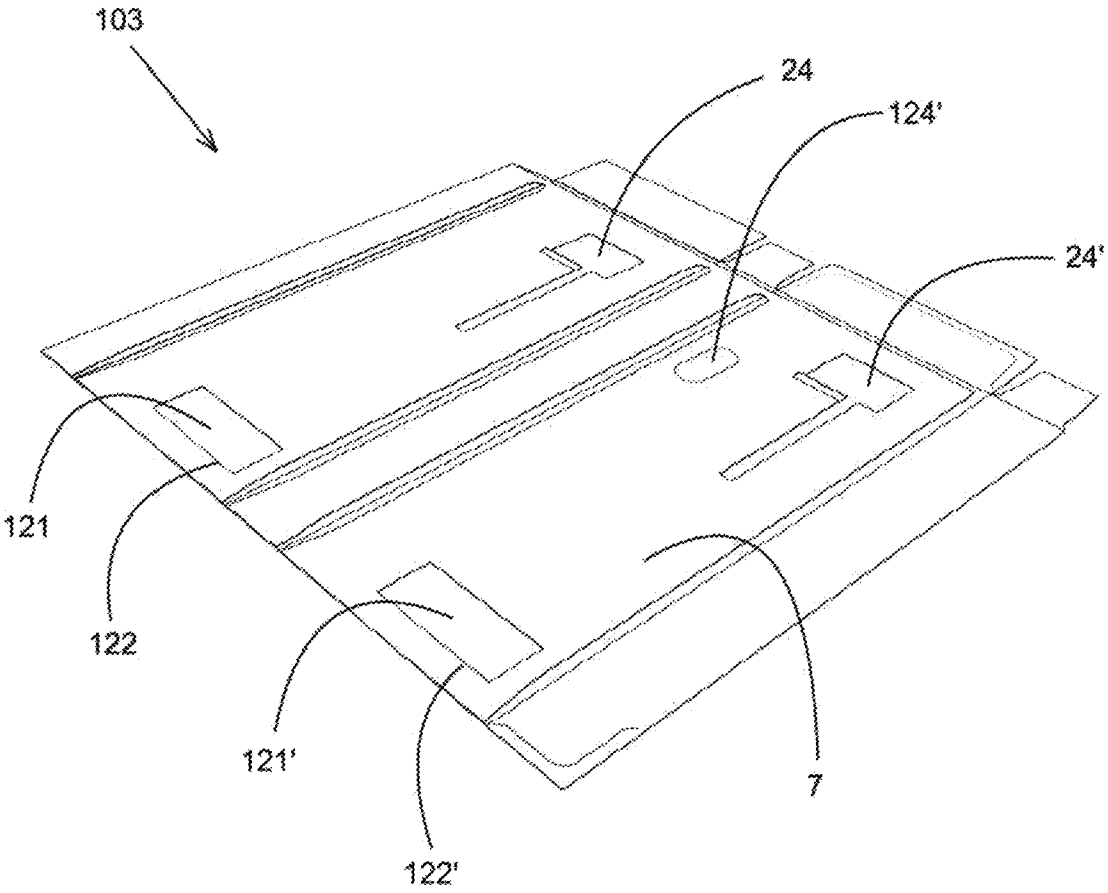
Figure 5D:
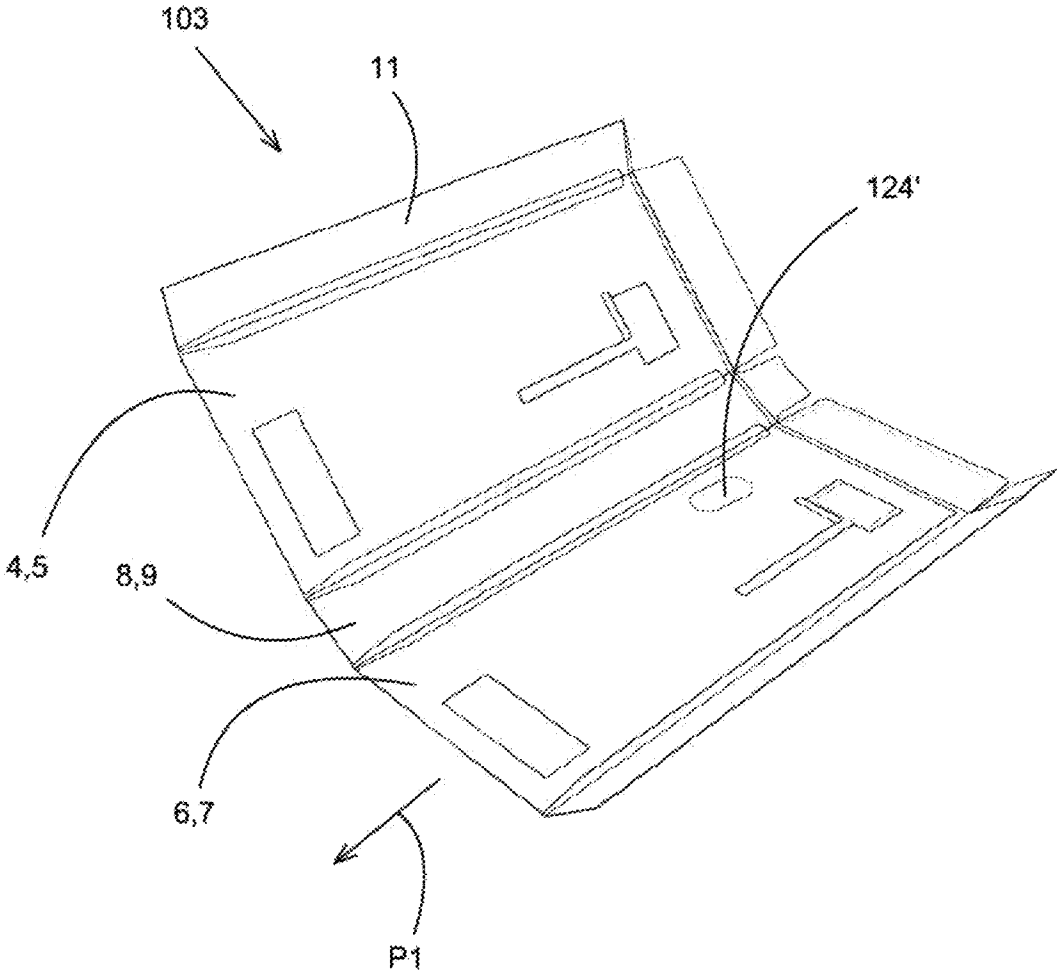
Figure 5E:
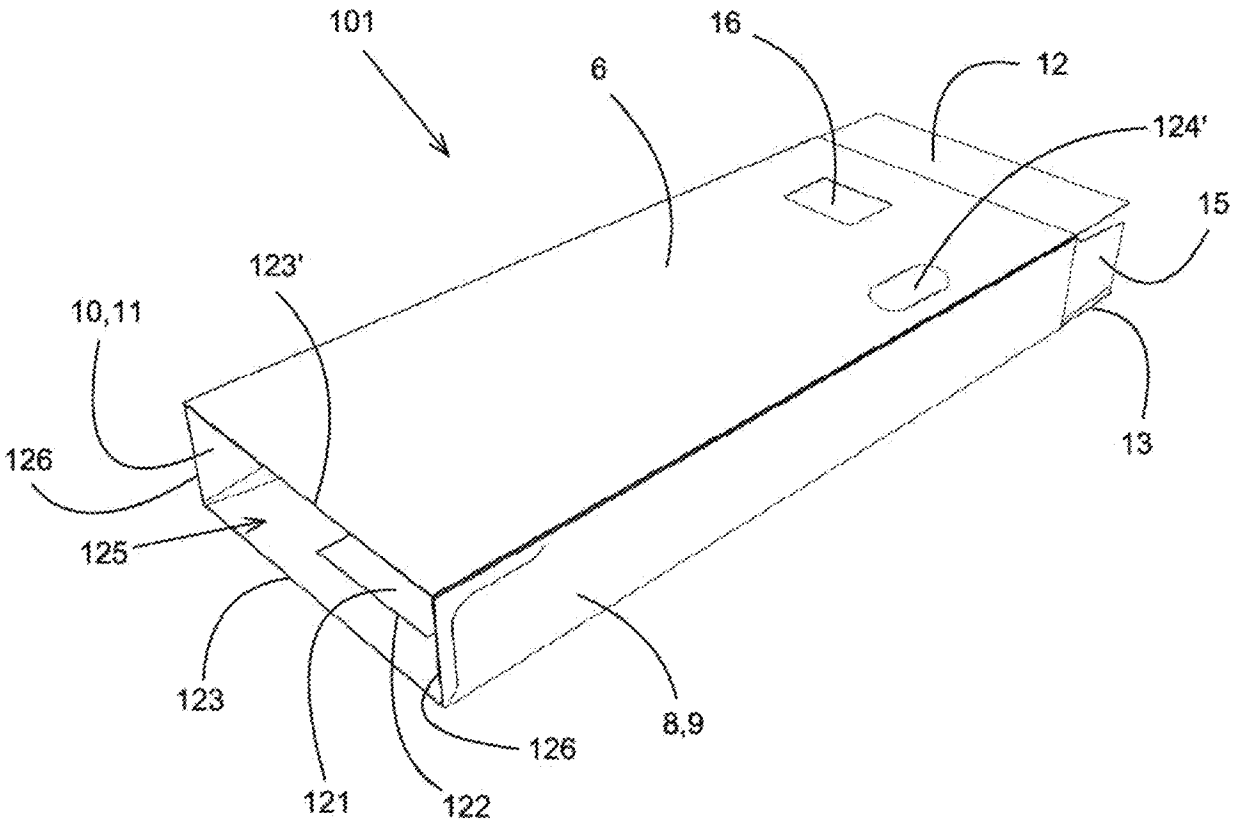
Figure 5F:
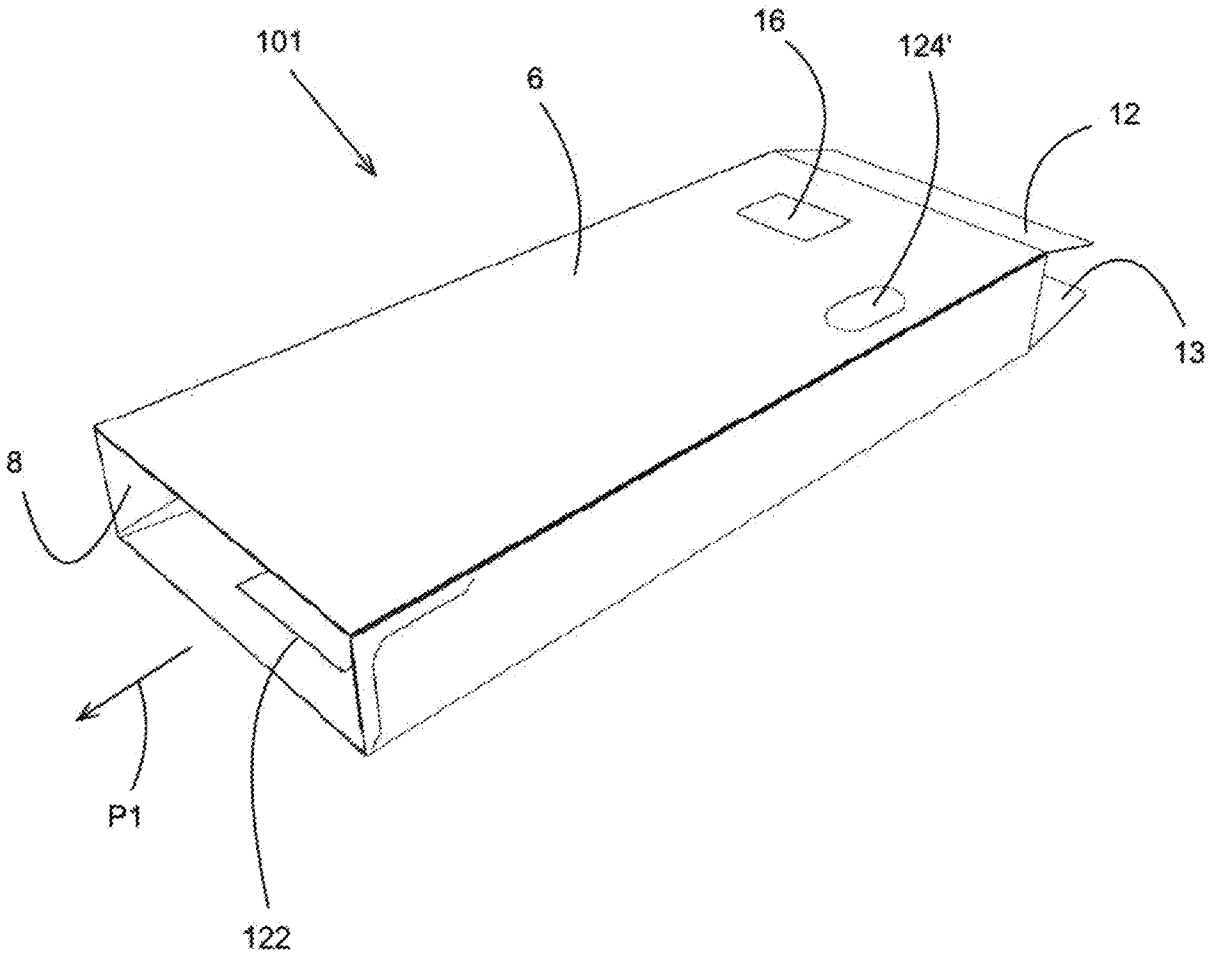
Figure 5G:
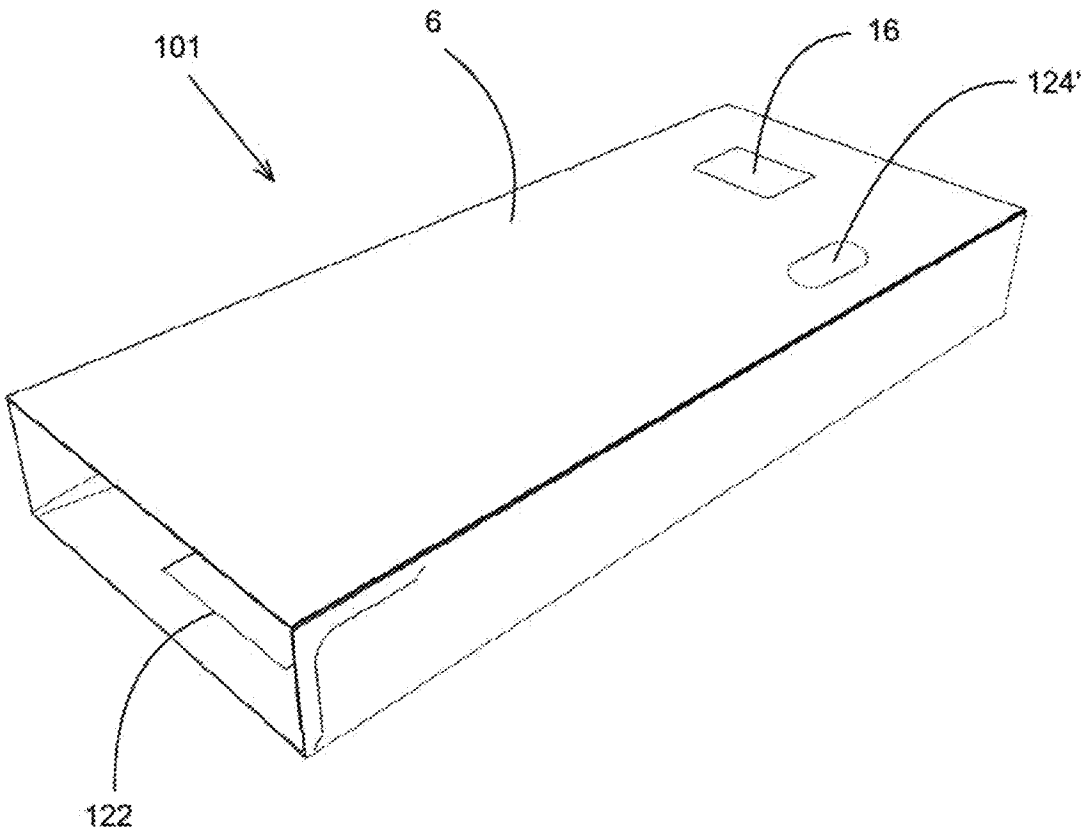

As can clearly been seen in FIG. 5E the front opening 125 of the housing 101 is defined by straight lines formed by outer rims 123, 123' as well as outer rims 126 of the side walls 8, 9, 10, 11. The front opening 125 is rectangular and has no cut outs to provide semi-circular gripping openings 20 like by the first embodiment.

Figure 6:
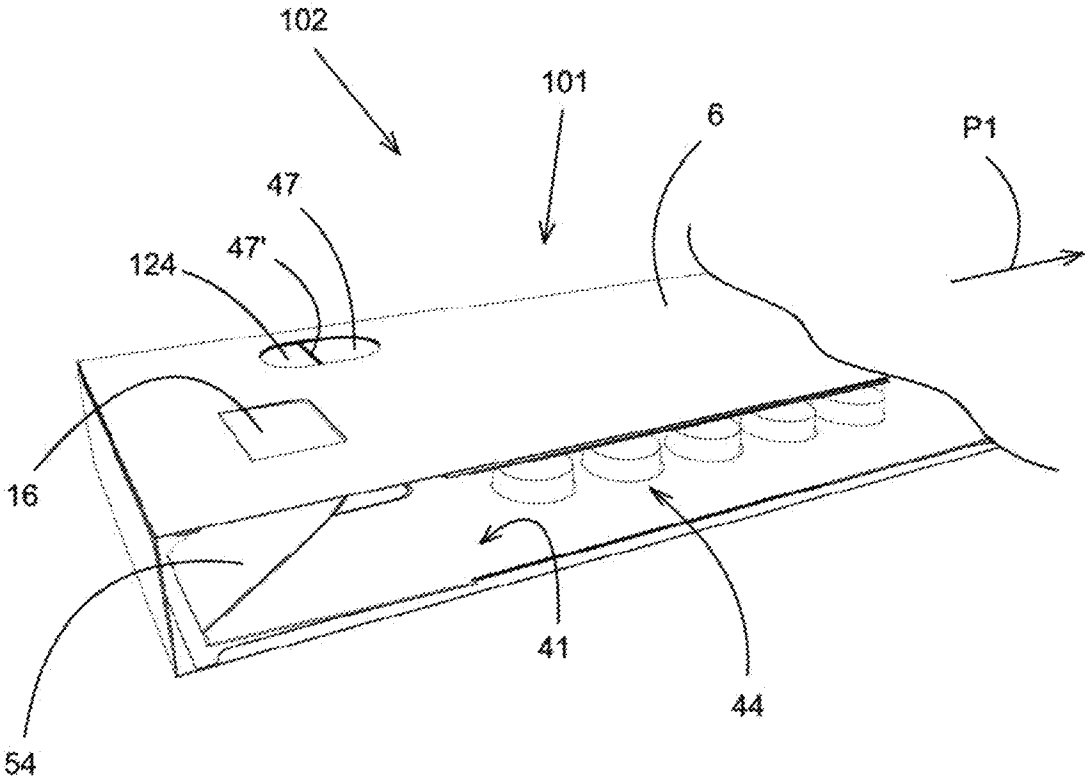
FIGS. 6 and 7 are perspective cross sections of the package comprising the housing as shown in the FIGS. 5A-5G and a slide shown in the FIGS. 2A-2K, in a locked position.

FIG. 6 is a perspective cross section of the package 102 comprising the housing 102 as well as a slide 41 provided with a single blister 44. The rectangular wall 63 (see FIG. 2K) of the slide 41 form a closure wall of the rectangular front opening 125 of the housing 101 when the slide 41 is located inside the housing 101, preventing any access to the inside of housing 101 and grip on the slide 41.

Figure 7:
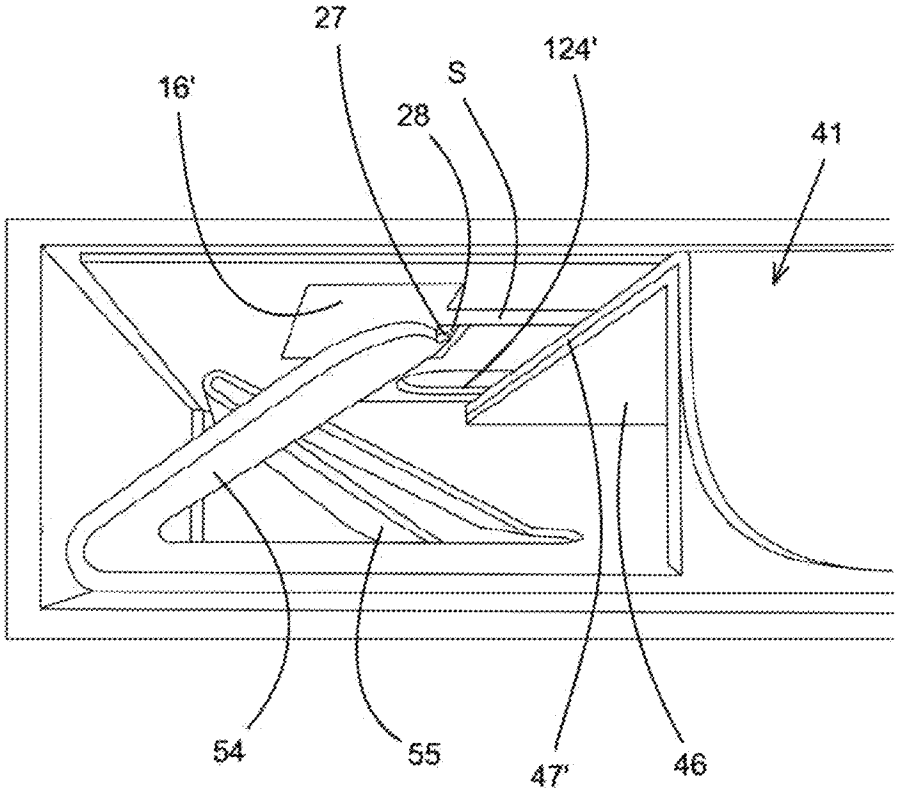

As can be seen in FIG. 7, the extension 54 is in its locked position, whereby the extension 54 is located in the recess 27 and abut against edge 28. In the same manner is extension 55 located in the recess 27' and abut against edge 28'.

In FIGS. 6 and 6 the aligned oval passages 124, 124' are visible. The oval passages 124, 124' are partly covered from the inside of the housing 102 by part 47 of the slide 41. A rear edge 47' (see also FIG. 2J) of part 47 is located near the middle of the oval passages 124, 124'. The rear edge 47' can be located anywhere in the oval passages 124, 124' as long as there is still enough open space in the oval passages 124, 124' to insert a finger or other object into the oval passages 124, 124' and to be able to push the slide 41 in the direction indicated by arrow P1.

Figure 8:
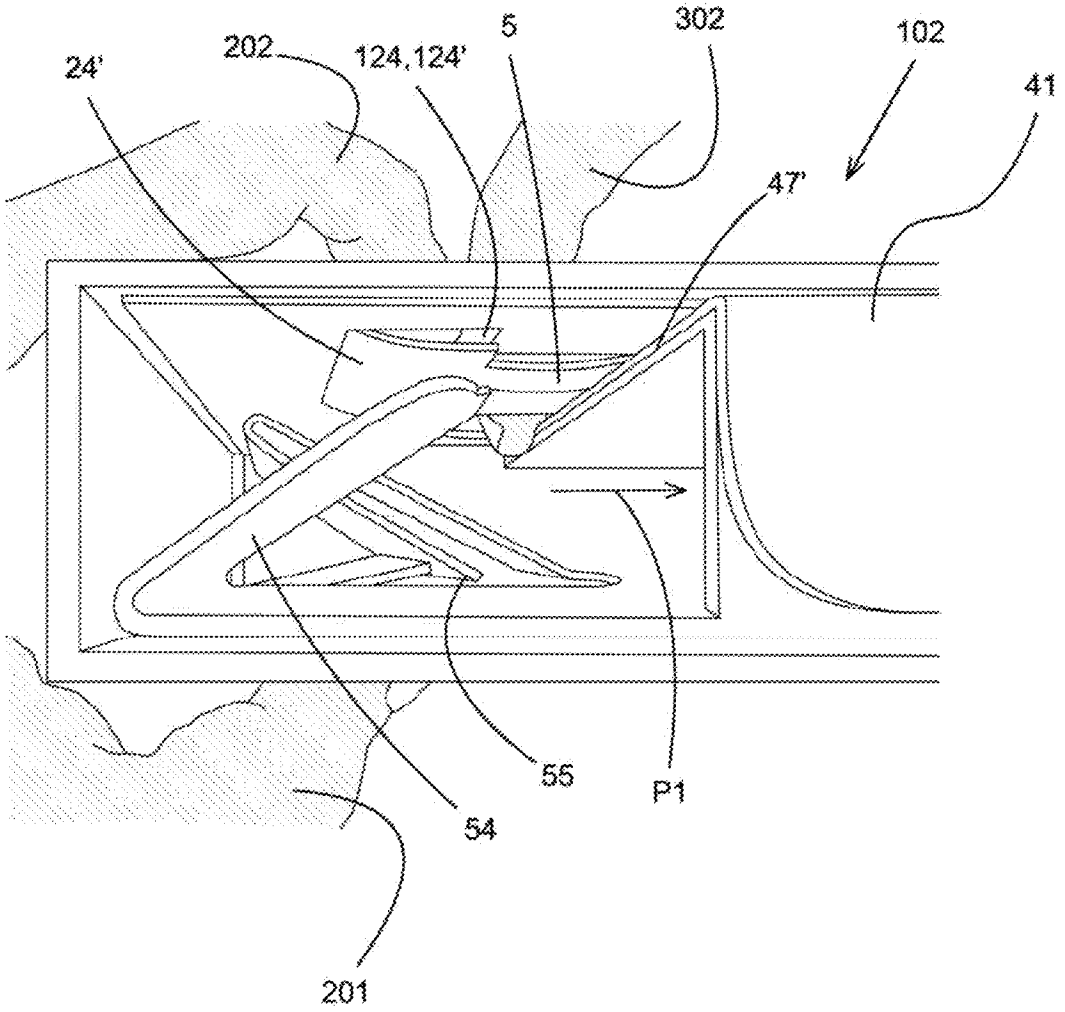
FIGS. 8 and 9 are perspective cross sections of the package comprising the housing as shown in the FIGS. 5A-5G and a slide shown in the FIGS. 2A-2K, in an unlocked position.
Figure 9:
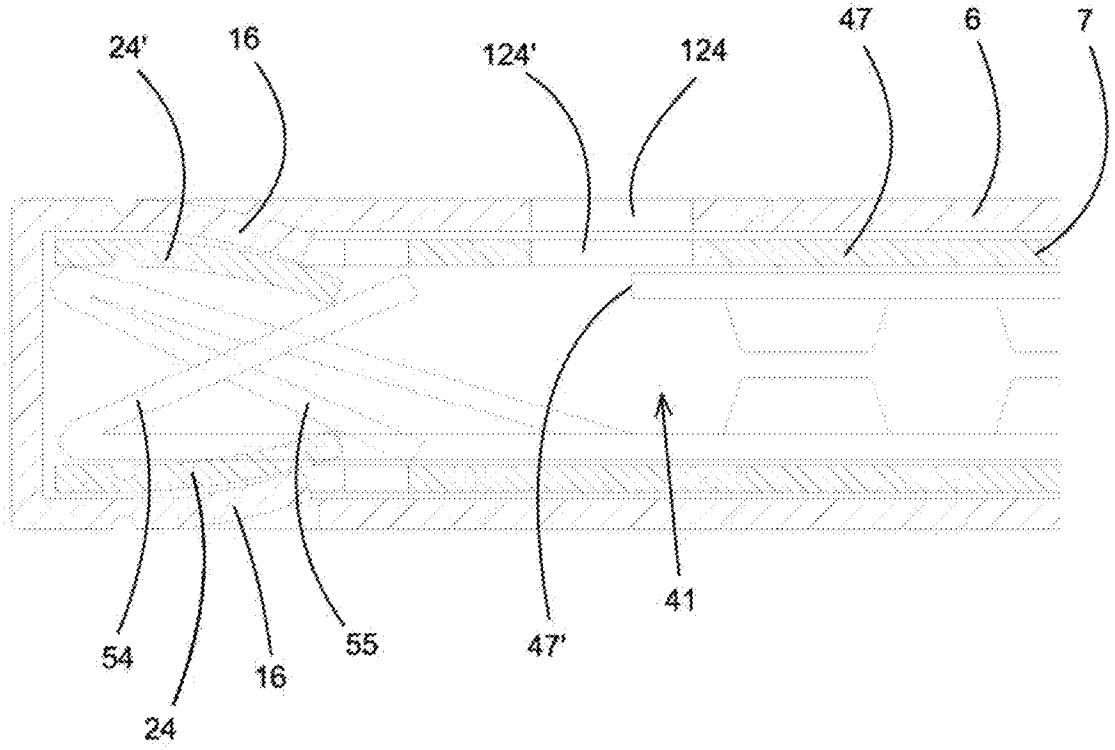

FIGS. 8 and 9 are perspective cross sections of the package 102, whereby a user has placed his thumb 201 and a finger 202 of a first hand against the flexible lips 16, 16'. By pushing against the flexible lips 16, 16, the flexible lips 24, 24' are pressed against the extensions 54, 55, thereby moving the extensions 54, 55 out of the recesses 27, 27' and out of engagement with the edges 28, 28'. The slide 41 is now unlocked. However, if the user would remove his first hand, the extensions 54, 55 will under spring force move back into engagement with the edges 28, 28' and will be locked again. To slide the slide 41 out of the housing 102, the user must maintain with his first hand the slide 41 in the unlocked position. While doing so, the user places his finger (or an object) 302 of his second hand into the passages 124, 124' and places his finger 302 against the rear edge 47' of the slide 41. The user pushes the slide 41 in the direction indicated by arrow P1 over a short distance. By doing so, the slide 41 is being brought in an unlocked, first intermediate position. In this position the extensions 54, 55 can not move back into engagement with the edges 28, 28' and will remain unlocked.

Figure 12:
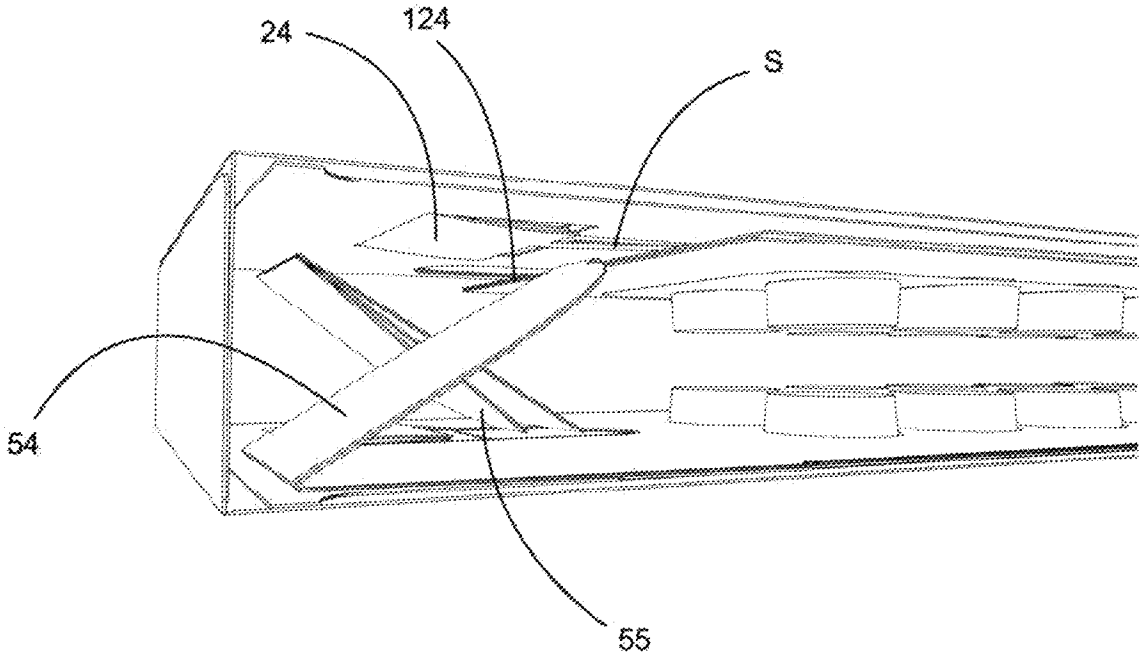

In FIGS. 9 and 12, the slide 41 is shown with two blisters.

Figure 10:
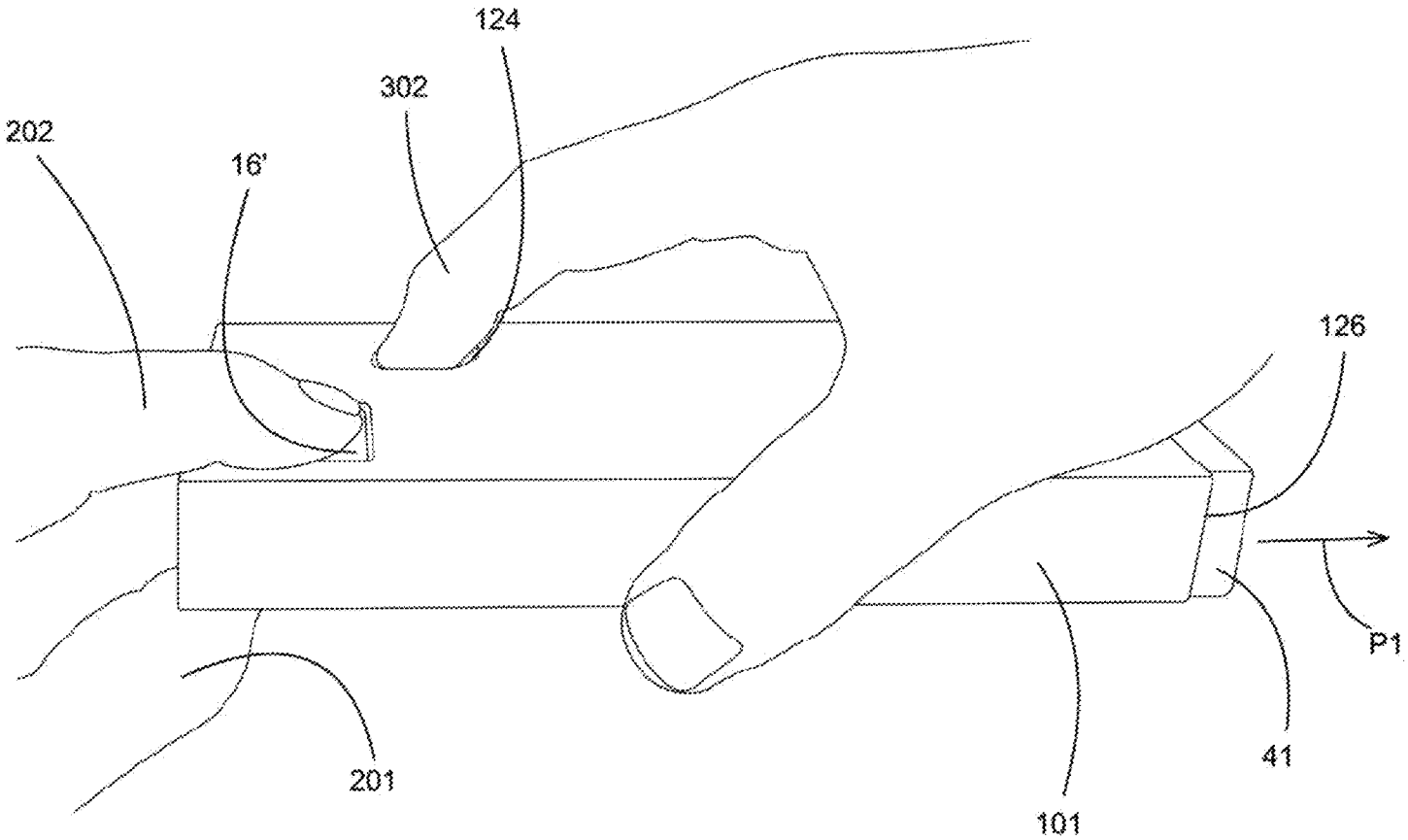
FIGS. 10, 11 and 12 are perspective views and cross sections of the package comprising the housing as shown in the FIGS. 5A-5G and a slide shown in the FIGS. 2A-2K, in a first intermediate position remaining the slide in an unlocked position.
Figure 11:
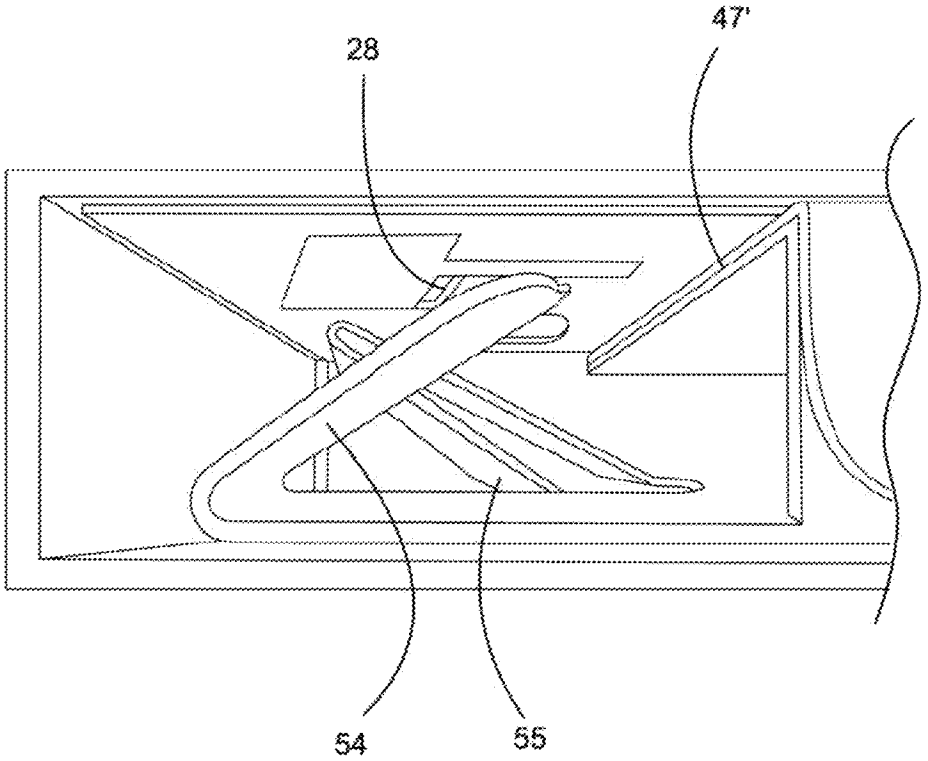
Figure 13:
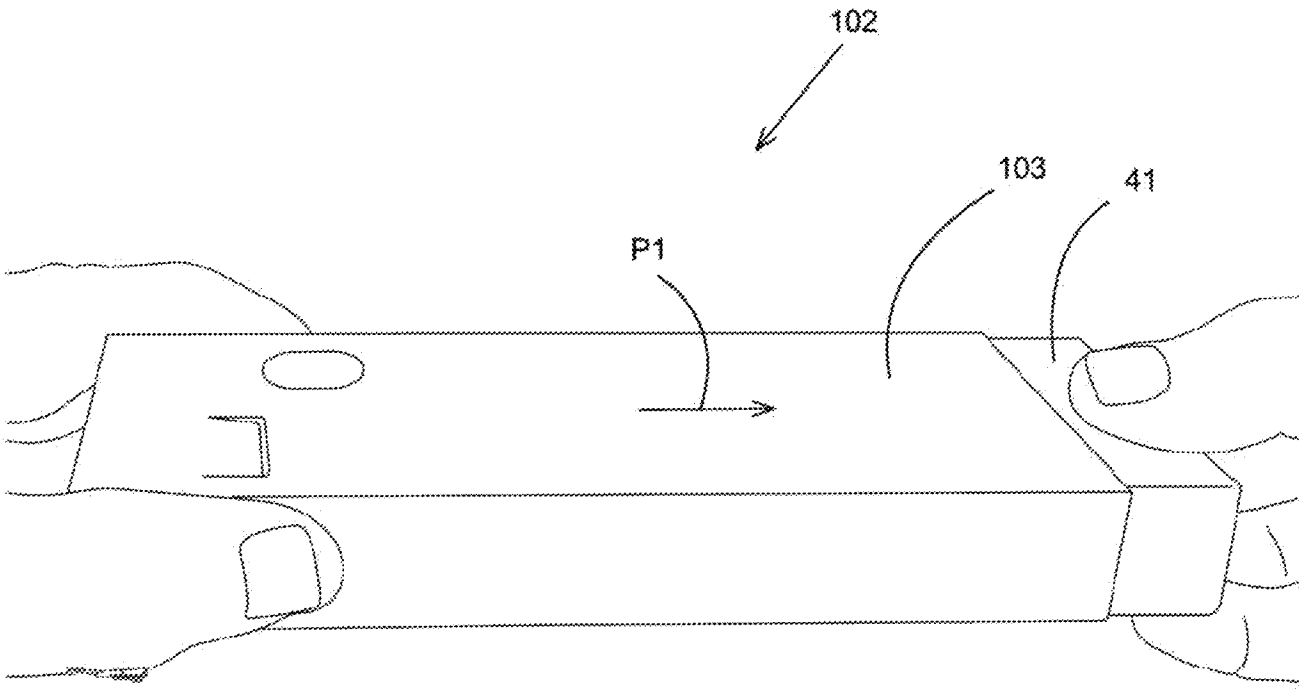
FIG. 13 is a perspective view of the package comprising the housing as shown in the FIGS. 5A-5G and a slide shown in the FIGS. 2A-2K, in a second intermediate position also remaining the slide in an unlocked position.

The unlocked, first intermediate position is well shown in the FIGS. 10, 11 and 12 whereby the slide 41 remains in an unlocked position, After placing the slide 41 in the unlocked, first intermediate position the user can now replace his first and second hand to the position as shown in FIG. 13 to pull the slide 41 out of the housing 102 into at least second intermediate position. The slide 41 can be moved out of the housing 1 till the end of extension 54 moves under spring force of the extension 54 itself into the recess 121 until it abuts against edge 122. The same happens with extension 55. It moves under spring force of the extension 55 itself into the recess 121' until it abuts against edge 122'. The slide 41 is thereby prevented from moving out of the housing In the first and second end position the cover 60 of the slide 41 can be opened to provide access to the blisters 44.

It is also possible to provide the package with a slide having only one extension cooperating with a recess in the housing, whereby the housing also has the passage. The passage can be located at the same side as the recess or at the opposite side. Through the passage the slide can be pushed into the unlocked position after the extension has been moved out of the recess. The front opening of the housing is thereby fully closed by the slide so that a child can not grip the slide from the front opening until the slide is moved by means of a finger or other object like a pen via the passage through the front opening.

However, preferably the package has a slide with two extensions cooperating with two recesses in the housing, whereby the housing also has the passage. By such a housing it will be very hard for a young child to open the package.

It is also possible to provide the passage in the top wall, the side wall or to provide more than one passages in one of the walls of the housing. The passage can also be provided in the rear wall.

It is also possible to make the housing and/or the slide from plastic or in another manner from carton.

The present disclosure relates to a package comprising a housing and a slide being slidably in a sliding direction accommodated in the housing from a locked position wherein the slide is locked inside the housing and at least an intermediate position wherein the slide is partly located outside a front opening of the housing, which housing comprises at least a bottom wall, a top wall and longitudinal side walls extending in the sliding direction, whereby the bottom wall and the top wall are connected to each other by means of the side walls, whereby the slide is provided with at least one extension lockable under spring force in the locked position in a blind recess located in the top wall of the housing near a rear end of the housing, whereby the at least one extension is movable against spring spring force out of the recess to allow the slide to be movable to at least the intermediate position.

A comparative package comprises an inner slide card slidably located inside an outer sleeve. The outer sleeve comprises a release button, an opening and a node. The inner slide card comprises an extension. Once the extension is moved past the opening, extension springs up and enters into the opening and is biased against the node. If the end user attempts to remove the inner slide card from the outer sleeve, the extension slides up along the opening to prevent the removal of the inner slide card from the outer sleeve. However, in order to deactivate the sliding movement of the extension along the opening, the end user merely has to push the release button such that the extension is pushed against the node and below the opening, thereby preventing the extension from sliding up through the opening.

A disadvantage of the comparative package is that a child can easily discover that he must push the button and pull on the inner slide card to slide the inner slide card out of the outer sleeve to get access to the content of the inner slide card. This renders the comparative package not suitable to be used as child resistant packaging tested against protocol US CFR 1700.20.

It is important to understand that child resistant packaging designs are heavily sought after since 1970 when in the US the PPPA (Poison Prevention Packaging Act) became effective. From that time onwards in the US only 'special packaging' could be used for regulated substances, and only packaging that was tested against US CFR 1700.20 was allowed to be used. Once a test is successfully passed, under the current regulation a packaging design does not have to be retested after a certain period of time. Presently young children (42-51 months) are in general a lot smarter than in 1970.

Designs that were successfully tested in the past, will for sure not pass testing today. Therefore, it is important to keep finding solutions that are focussed on staying on that thin line of what young children cannot do, and keeping it easy for adults and seniors.

At least one of the objects of the present disclosure is to provide a package which is child resistant and senior-friendly, meaning that young children can not open it, whilst seniors will be able to open it easily.

This object is accomplished with the package according to the present disclosure in that that the slide is provided with at least one other extension lockable under spring force in the locked position in a blind recess located in the bottom wall of the housing, whereby the at least one extension as well as the at least one other extension must be moved both out of the corresponding recess to allow the slide to be movable to at least the intermediate position and/or the bottom wall, the top wall and/or the side wall of the housing is provided with at least one passage, through which a rear side of the slide is reachable for pushing the slide from the locked position towards the intermediate position.

By having at least one additional operation to be performed to move the slide towards the front opening, a child will not be able to open the packaging or will have difficulties to open it.

Such an additional operation is necessary when having two extensions cooperating with recesses in the top wall and in the bottom wall respectively, whereby a person must move both extensions out of the corresponding recesses before the slide can be moved to the intermediate position. In the intermediate position access to the content of the slide is preferably possible.

If a person first moves one extension out of its corresponding recess, subsequently release the one extension to move the other extension out of its corresponding recess, the one extension will move back under spring force into engagement with its corresponding recess. So both extensions must be moved out of the corresponding recesses and remain in such unlocked position before the slide is movable to at least the intermediate position. Preferably the extensions are moved simultaneously out of the corresponding recesses.

For a young child it will be hard or even impossible to move both extensions out of engagement of the recesses and to move the slide out of the housing. For a senior such operation will be easily to perform.

The extensions might be accessible to be moved against spring force through openings in the housing or might be accessible to be moved against spring force by pressing on a part of the housing.

Such an additional operation is also necessary when the bottom wall, the top wall and/or the side wall of the housing is provided with at least one passage, through which a rear side of the slide is reachable for pushing the slide from the locked position towards the intermediate position. In such a case the slide can not be moved unless firstly a person moves the extension out of its corresponding recess and secondly the person puts for example his finger into the passage to push the slide towards the intermediate position into un unlocked position. As soon as the slide has been pushed into un unlocked position, whereby it is located slightly out of the front opening, a person may grip a front end of the slide and pulls the slide further out of the housing.

It will be even more difficult for a young child if it needs to perform both additional operations so move both extensions out of engagement of the recesses, subsequently puts his finger into the passage to push the slide towards the intermediate position into un unlocked position, grip a front end of the slide and pull the slide further out of the housing. For a young child it will be hard to move both extensions out of engagement of the recesses and find the mechanism of pushing the slide to the unlocked position and subsequently move the slide out of the housing. For a senior such operation will be easily to perform.

The front opening of the housing can be completely closed by the slide, so that access to the interior of the package via the front opening is efficiently prevented.

An embodiment of the package according to the present disclosure is characterized in that the at least one passage is located near one of the blind recesses.

Since both the recess and the passage are located near the rear of the slide so also near the rear of the housing when the slide is located inside the housing, it will be difficult for a child foresee that operations need to be performed at the rear of the housing to get the slide out of the front of the housing.

An embodiment of the package according to the present disclosure is characterized in that the top wall and the bottom wall of the housing are provided with flexible lip being pivotable with respect to the respective top wall and bottom wall, which flexible lip cooperate with the at least one extension as well as the at least one other extension respectively to move the at least one extension as well as the at least one other extension out of the corresponding recess.

The lips are located above the extensions, whereby pushing on the lips will move the extensions against spring force out of engagement of the recesses.

Another embodiment of the package according to the present disclosure is characterized in that seen in a direction perpendicular to the sliding direction and parallel to the top wall and bottom wall of the housing, the flexible lips are off set with respect to each other.

By having an off-set location of the flexible lips it will be even harder for a child to locate its fingers on the off-set lips, to operate them simultaneously, to keep pressing on the off-set lips whilst also pulling on the slide to move it out of the housing.

Another embodiment of the package according to the present disclosure is characterized in that seen in a direction perpendicular to the sliding direction and parallel to the top wall and bottom wall of the housing, the at least one extension as well as the at least one other extension are off set with respect to each other.

This makes it easier to provide the slide with extensions directed to the top wall and the bottom wall. Furthermore, in case that the extensions cooperate with the off-set lips, the off-set of the extensions and the lips will be substantially the same or at least so that each lip can cooperate with the corresponding extension.

Another embodiment of the package according to the present disclosure is characterized in that the top wall and/or the bottom wall are provided with flaps folded inside the housing, which flaps are located seen in the sliding direction near a front side of the housing, whereby the flaps cooperate with the at least one extension of the slide and/or the at least one other extension of the slide respectively to prevent the slide from being completely slide out of the housing.

It is a requirement in many countries that a slide containing drugs may not be detached from its housing. By using the extensions already present on the slide for locking the slide with respect to the housing also for preventing the slide from being completely slide out of the housing, no additional extensions are needed on the slide.

Another embodiment of the package according to the present disclosure is characterized in that the housing and/or slide are made of a carton blank or plastic.

Such materials are suitable for making disposable packages.

Another embodiment of the package according to the present disclosure is characterized in that the housing is made of a carton blank whereby after folding of the blank into the housing, the top wall and the bottom wall each comprises at least two parts of the blank located on top of each other, whereby the part directed to the inside of the housing is provided with the recess.

By having two parts of the blank located on top of each other and preferably connected to each other a sturdy top wall and bottom wall are obtained. Furthermore, by proving the part directed to the inside of the housing with the recess, the part directed to the outside of the housing will cover the recess so that in a simple manner a blind recess is obtained. Such blind recess is not visible nor accessible from the outside of the housing.

Another embodiment of the package according to the present disclosure is characterized in that at least the part directed to the outside of the housing is provided with the flexible lip.

By means of the flexible lip the extension can be pushed out of engagement of the recess. Such lip can easily be provided in the blank.

Another embodiment of the package according to the present disclosure is characterized in that the part directed to the inside of the housing is also provided with the flexible lip, whereby the flexible lips of the parts directed to the outside and inside of the housing are connected to each other, whereby the flexible lip of the part directed to the inside of the housing is larger that the flexible lip of the part directed to the outside of the housing.

By having the lip made of parts directed to the outside and inside of the housing, a strong flexible lip is obtained. By making the flexible lip of the part directed to the inside of the housing larger that the flexible lip of the part directed to the outside of the housing, the flexible lip can only be moved into the housing but not out of the housing. This has the advantage that the lip can not be torn of the housing. Another advantage is that it will prevent full access to the passage through which the flexible lip is movable with respect to the top wall and bottom wall.

Clause 1. A package (2, 102) comprising a housing (1, 101) and a slide (41) being slidably in a sliding direction accommodated in the housing (1, 101) from a locked position wherein the slide (41) is locked inside the housing (1, 101) and at least an intermediate position wherein the slide (41) is partly located outside a front opening of the housing (1, 101), which housing (1, 101) comprises at least a bottom wall (6, 7), a top wall (4, 5) and longitudinal side walls (8, 9, 10, 11) extending in the sliding direction, whereby the bottom wall (6, 7) and the top wall (4, 5) are connected to each other by means of the side walls (8, 9, 10, 11), whereby the slide (41) is provided with at least one extension (54, 55) lockable under spring force in the locked position in a blind recess (21, 21', 27, 27', 121, 121') located in the top wall (4, 5) of the housing (1, 101) near a rear end of the housing (1, 101), whereby the at least one extension (54, 55) is movable against spring spring force out of the recess to allow the slide to be movable to at least the intermediate position, characterized in that the slide is provided with at least one other extension lockable under spring force in the locked position in a blind recess (21, 21', 27, 27', 121, 121') located in the bottom wall of the housing (1, 101), whereby the at least one extension (54, 55) as well as the at least one other extension (54, 55) must be moved both out of the corresponding recess (21, 21', 27, 27', 121, 121') in the respective top wall and bottom wall of the housing to allow the slide (41) to be movable to at least the intermediate position at least the bottom wall (6, 7), the top wall (4, 5) and/or the side wall (8, 9, 10, 11) of the housing (1, 101) is provided with at least one passage (124, 124'), through which a rear side of the slide (41) is reachable for pushing the slide (41) from the locked position towards the intermediate position.

Clause 2. A package (2, 102) according to clause 1, characterized in that the at least one passage (124, 124') is located near one of the blind recesses (21, 21', 27, 27', 121, 121').

Clause 3. A package (2, 102) according to clause 1 or 2, characterized in that the top wall (4, 5) and the bottom wall (6, 7) of the housing (2, 102) are provided with a flexible lip (16, 16', 24, 24') being pivotable with respect to the respective top wall (4, 5) and bottom wall (6, 7), which flexible lip (16, 16', 24, 24') cooperate with the at least one extension as well as the at least one other extension (54, 55) respectively to move the at least one extension (54, 55) as well as the at least one other extension (54, 55) out of the corresponding recess (21, 21', 27, 27', 121, 121').

Clause 4. A package (2, 102) according to clause 3, characterized in that seen in a direction perpendicular to the sliding direction and parallel to the top wall (4, 5) and bottom wall (6, 7) of the housing, the flexible lips (16, 16', 24, 24') are off set with respect to each other.

Clause 5. A package (2, 102) according to one of the preceding clauses, characterized in that seen in a direction perpendicular to the sliding direction and parallel to the top wall (4, 5) and bottom wall (6, 7) of the housing, the at least one extension (54, 55) as well as the at least one other extension (54, 55) are off set with respect to each other.

Clause 6. A package (2, 102) according to one of the preceding clauses, characterized in that the top wall (4, 5) and/or the bottom wall (6, 7) of the housing are provided with flaps folded inside the housing, which flaps (30) are located seen in the sliding direction near a front side of the housing (1, 101), whereby the flaps (30) cooperate with the at least one extension (54, 55) of the slide (41) and/or the at least one other extension (54, 55) of the slide (41) respectively to prevent the slide (41) from being completely slide out of the housing (1, 101).

Clause 7. A package (2, 102) according to one of the preceding clauses, characterized in that the housing (1, 101) and/or slide (41) are made of a carton blank or plastic.

Clause 8. A package (2, 102) according to clause 7, characterized in that the housing (1, 101) is made of a carton blank (3) whereby after folding of the blank (3) into the housing (1, 101), the top wall (4, 5) and the bottom wall (6, 7) each comprises at least two parts of the blank (3) located on top of each other, whereby the part directed to the inside of the housing (1, 101) is provided with the recess (21, 21', 27, 27', 121, 121').

Clause 9. A package (2, 102) according to clause 3 and 8, characterized in that at least the part directed to the outside of the housing (1, 101) is provided with the flexible lip (16, 16', 24, 24').

Clause 10. A package (2, 102) according to clause 9, characterized in that the part directed to the inside of the housing (1, 101) is also provided with the flexible lip (16, 16', 24, 24'), whereby the flexible lips (16, 16', 24, 24') of the parts directed to the outside and inside of the housing (1, 101) are connected to each other, whereby the flexible lip (16, 16', 24, 24') of the part directed to the inside of the housing (1, 101) is larger that the flexible lip (16, 16', 24, 24') of the part directed to the outside of the housing (1, 101).

LIST OF REFERENCES

1 housing
2 package
3 blank
4 outer top wall part
5 inner top wall part
6 outer bottom wall part
7 inner bottom wall part
8 first outer side wall part
9 first inner side wall part
10 second outer side wall part
11 second inner side wall parts
12 first rear wall part
13 second rear wall part
14 third rear wall part
15 fourth rear wall part
16 flexible lip
16' flexible lip
17 three cut through line
17' three cut through line
18 folding line
18' folding line
19 cut a way part
19' cut a way part
20 semi-circular gripping opening
20' semi-circular gripping opening
21 secondary recess
21' secondary recess
22 edge
22' edge
24 flexible lip
24' flexible lip
25 cut through line
25' cut through line
26 folding line
26' folding line
26" folding line
27 primary recess
27' recess
28 edge
28' edge
30 flap
41 slide
42 blank
43 holes
44 blister
45 pocket
46 part
47 part
47' rear edge
48 part
49 part
50 side part
51 part
52 part
53 part
54 extension
55 extension
56 part
57 part
60 cover
61 opening
62 wall
63 wall
101 housing
102 package
121 secondary recess
121' secondary recess
123 outer rim
123' outer rim
124 oval passage
124' oval passage
125 front opening
126 outer rim
201 thumb
202 finger
302 finger
S flexible strip
P1 arrow
P2 arrow
P3 arrow

The invention claimed is:

1. A package comprising a housing and a slide being slidable in a sliding direction accommodated in the housing from a locked position wherein the slide is locked inside the housing and at least an intermediate position wherein the slide is partly located outside a front opening of the housing, which the housing comprises at least a bottom wall, a top wall, and longitudinal side walls extending in the sliding direction, whereby the bottom wall and the top wall are connected to each other by the longitudinal side walls, whereby the slide is provided with at least one extension lockable under spring force in the locked position in a blind recess located in the top wall of the housing near a rear end of the housing, whereby the at least one extension is movable against spring force out of the blind recess located in the top wall of the housing to allow the slide to be movable to at least the intermediate position, wherein the slide is provided with at least one other extension lockable under spring force in the locked position in a blind recess located in the bottom wall of the housing, whereby the at least one extension as well as the at least one other extension must be moved both out of the blind recess in the respective top wall and bottom wall of the housing to allow the slide to be movable to at least the intermediate position, while at least the bottom wall, the top wall and/or the side wall of the housing is provided with at least one passage, through which a rear side of the slide is reachable for pushing the slide from the locked position towards the intermediate position; and wherein when seen in a direction perpendicular to the sliding direction and parallel to the top wall and bottom wall of the housing, the at least one extension as well as the at least one other extension are off set with respect to each other.

2. The package of claim 1, wherein the at least one passage is located near one of the blind recesses.

3. The package of claim 1, wherein the top wall and the bottom wall of the housing are provided with at least one flexible lip being pivotable with respect to the respective top wall and bottom wall, which at least one flexible lip cooperates with the at least one extension as well as the at least one other extension respectively to move the at least one extension as well as the at least one other extension out of the corresponding blind recess.

4. The package of claim 3, wherein when seen in the direction perpendicular to the sliding direction and parallel to the top wall and bottom wall of the housing, the flexible lips are off set with respect to each other.

5. The package of claim 3, wherein at least a part directed to the outside of the housing is provided with the flexible lip.

6. The package of claim 5, wherein the part of the at least two parts directed to the inside of the housing is also provided with the at least one flexible lip, whereby the flexible lips of the parts directed to the outside and inside of the housing are connected to each other, whereby the at least one flexible lip of the part directed to the inside of the housing is larger than the flexible lip of the part directed to the outside of the housing.

7. The package of claim 1, wherein the top wall and/or the bottom wall of the housing are provided with flaps folded inside the housing, which flaps are located seen in the sliding direction near a front side of the housing, whereby the flaps cooperate with the at least one extension of the slide and/or the at least one other extension of the slide respectively to prevent the slide from being completely slid out of the housing.

8. The package of claim 1, wherein the housing and/or slide are made of a carton blank or plastic.

9. The package of claim 8, wherein the top wall and the bottom wall of the housing are provided with at least one flexible lip being pivotable with respect to the respective top wall and bottom wall, which at least one flexible lip cooperates with the at least one extension as well as the at least one other extension respectively to move the at least one extension as well as the at least one other extension out of the corresponding recess.

10. The package of claim 9, wherein the housing is made of a carton blank whereby after folding of the carton blank into the housing, the top wall and the bottom wall each comprises at least two parts of the carton blank located on top of each other, whereby the part of the at least two parts directed to the inside of the housing is provided with the recess.

11. The package of claim 10, wherein at least the part directed to the outside of the housing is provided with the flexible lip.

12. The package of claim 11, wherein the part directed to the inside of the housing is also provided with the flexible lip, whereby the flexible lips of the parts directed to the outside and inside of the housing are connected to each other, whereby the flexible lip of the part directed to the inside of the housing is larger than the flexible lip of the part directed to the outside of the housing.

* * * * *